US006164991A

United States Patent [19]

Matsuura et al.

[11] Patent Number: 6,164,991

[45] Date of Patent: Dec. 26, 2000

[54] SLIDABLY ATTACHING TYPE CONNECTOR

[75] Inventors: Toshifumi Matsuura; Toshiaki Okabe; Shinji Kodama, all of Shizuoka, Japan

[73] Assignee: Yazaki Corporation, Tokyo, Japan

[21] Appl. No.: 09/201,159

[22] Filed: Nov. 30, 1998

Related U.S. Application Data

[63] Continuation-in-part of application No. 09/103,560, Jun. 24, 1998, Pat. No. 6,030,236.

[30] Foreign Application Priority Data

| | | | |
|---|---|---|---|
| Jun. 27, 1997 | [JP] | Japan | 9-172227 |
| Nov. 28, 1997 | [JP] | Japan | 9-328255 |
| Nov. 28, 1997 | [JP] | Japan | 9-328262 |
| Nov. 28, 1997 | [JP] | Japan | 9-328263 |

[51] Int. Cl.[7] ..... H01R 13/62

[52] U.S. Cl. ..... 439/157; 439/160

[58] Field of Search ..... 439/157, 151, 439/159, 152, 153, 160, 154, 155, 372

[56] References Cited

U.S. PATENT DOCUMENTS

| | | | |
|---|---|---|---|
| 5,362,245 | 11/1994 | Suguro et al. | 439/160 |
| 5,431,573 | 7/1995 | Endo et al. | 439/157 |
| 5,954,528 | 9/1999 | Ono et al. | 439/157 |
| 5,980,283 | 11/1999 | Okabe | 439/157 |
| 6,045,384 | 4/2000 | Norizuki et al. | 439/310 |

*Primary Examiner*—Neil Abrams
*Assistant Examiner*—Michael C. Zarroli
*Attorney, Agent, or Firm*—Morgan, Lewis & Bockius LLP

[57] ABSTRACT

A slidably attaching type connector includes female type connector housing that is attached to and detached from a male type connector housing by using a slide member and a lever. One of the connector housings is slidably received within the slide member. When moving the slide member in one direction, the tip end portion of the lever engages with one engaging portion of the other connector housing to draw the one of the connector housings within the other connector housing, thereby attaching the male type and female type connector housings to each other. When moving the slide member in a direction opposite to the one direction, another tip portion of the lever engages with the other engaging portion of the other connector housing to detach one of the connector housings from the other connector housing.

16 Claims, 19 Drawing Sheets

SLIDABLY ATTACHING TYPE CONNECTOR

This is a continuation-in-part of application Ser. No. 09/103,560 filed on Jun. 24, 1998 (issued as U.S. Pat. No. 6,030,236 on Feb. 29, 2000).

BACKGROUND OF THE INVENTION

The present invention relates to a slidably attaching type connector in which, when a slide member is slid reciprocally in an attaching and detaching direction of multi-pole female type and male type connector housings, both the connector housings are easily attached to and detached from each other by the leverage of a lever which is rotated by sliding the slide member with a small operation force applied to the slide member.

An example of lever type connectors using lever function is shown in FIGS. 6A and 6B. In FIGS. 6A and 6B, a lever type connector 1 includes a multi-terminal (pole) female connector housing 2. The frame support portion 3 of the female connector housing 2 has a slide groove 4. A slide shaft 6 protruded from the lower side of one end of a frame shaped lever 5 is disposed within and supported by the slide groove so as to be freely slidable within the groove. A pair of male connector housings 7, 7 attachable to and detachable from the female connector housing 2 are rotatably supported by a supporting shaft 8 within the frame shaped lever 5.

When a lever operation portion 9 protruded from the upper side of the other end of the frame shaped lever 5 is operated upward or downward to rotate the lever 5 around the slide shaft 6, the connector housing 2 is attachable to and detachable from the connector housings 7, 7. The technique similar to the lever type connector 1 is disclosed in Japanese Utility Model Unexamined Publication No. Hei.6-79080.

However, according to the conventional lever type connector 1, in the case of attaching the male connector housings 7 to the female connector housing 2 in a small mounting space where the female connector housing 2 can not be seen, for example, a person is required to grope for positioning the slide shaft 6 serving as a fulcrum of the lever 5 at the slide groove 4 of the flame support portion 3 of the female connector housing 2 and to insert into and engage with the slide groove. Such an operation requires skilled operation and so the attaching operation of the male and female connector housings 2, 7 is troublesome. In particular, at the time of attaching the male connector housings 7 to the female connector housing 2, first, both the male and female connectors 2, 7 are provisionally attached and second, the lever operation portion 9 is pressed. In this manner, since two steps of the operations are required, it is required to change the holding position of the lever 5 when performing the second operation. Further, since the slide shaft 6 and the lever operation portion 9 are protruded at both sides of the lever 5 supporting the male connector housings 7, the entire size of the connector is large. Furthermore, there is a possibility that, as a result of external load forces, the slide shaft 6 of the lever 5 may come out of the slide groove 4 of the frame support portion 3 and the slide shaft 6 and the lever operation portion 9 protruded at both sides of the lever 5 may be broken.

SUMMARY OF THE INVENTION

The invention was made in order to solve the above-mentioned problem and intends to provide a small-sized slidably attaching type connector with good operability in which one connector housing can be easily attached to and detached from the other connector housing using the mechanical advantage of a lever contained in a slide member by merely sliding the slide member in an attaching and a detaching direction with a small operation force.

According to a first aspect of the invention, in a slidably attaching type connector in which a slide member is provided in one of female type and male type connector housings so as to be slidable reciprocally therein, a base end portion of a lever rotated by the reciprocal movement of the slide member is rotatably supported by the slide member through a supporting shaft. An intermediate portion of the lever is interlocked with a point of action of the one of the female type and male type connector housings, and, at a time of attaching and detaching both the connector housings to each other, a tip end portion of the lever is free to attach to and detach from a pair of engaging portions of the other connector housing.

The slide member is provided so as to be slidable reciprocally within the one of the female type and male type connector housings in the attaching and detaching direction of the female type and male type connector housings.

When the slide member is moved in one direction, the tip end portion of the lever engages with one of the pair of engaging portions of the other connector housing to draw the one of the female type and male type connector housings within the other connector housing, thereby attaching both the female type and male type connector housings to each other.

When the slide member is moved in a direction opposite to the one direction, the tip end portion of the lever engages with the other of the pair of engaging portions of the other connector housing, thereby detaching the one of the female type and male type connector housings from the other connector housing.

The slidably attaching type connector according to the invention allows the attaching and detaching operation between the female type and male type connector housings to be performed easily by merely sliding the slide member in the attaching and detaching direction of the connector housings. In this case, the female type and male type connector housings are smoothly and surely attached to and detached from each other by the leverage of the lever when sliding the slide with a small operation force.

According to another aspect of the invention, the slide member is slidably received within the one of the female type and male type connector housings, and the lever is provided between the slide member and the one of the female type and male type connector housings, and is contained within the slide member. Because the lever is arranged so as to be contained within the slide member and not to protrude outside thereof, breakage of the lever resulting from the application of an external load force can be prevented. Accordingly, the attaching and detaching operation between the male type and female type connector housings can be performed surely and easily without reducing the leverage of the lever.

According to another aspect of the invention, a slot is formed at an intermediate portion of the lever, with the slot being slidably engaged with a support pin serving as a point of action on the one of the female type and male type connector housings, whereby the tip end portion of the lever is free to attach to and detach from the pair of engaging portions of the other connector housing.

Another advantage of the slidably attaching type connector according to the invention is that the length of the lever can be made shorter, thus reducing the entire size of the connector.

According to yet another aspect of the invention, the slide member is formed in a rounded rectangular shape, with slits being formed at opposed positions of center portions of upper and lower walls of the slide member. The base end portion of the lever is rotatably supported within one of the slits through a pivot, and the tip end portion of the lever is freely inserted in and separated from the other of the slits.

The attaching and detaching operation between the multipole female type and male type connector housings of the invention can be performed surely and easily, and the number of the parts of the connector can be reduced, thereby reducing the entire cost of the connector.

DETAILED DESCRIPTION OF THE PREFERRED EMBODIMENTS

An embodiment of the invention will be described with reference to the accompanying drawings.

Figure 1:
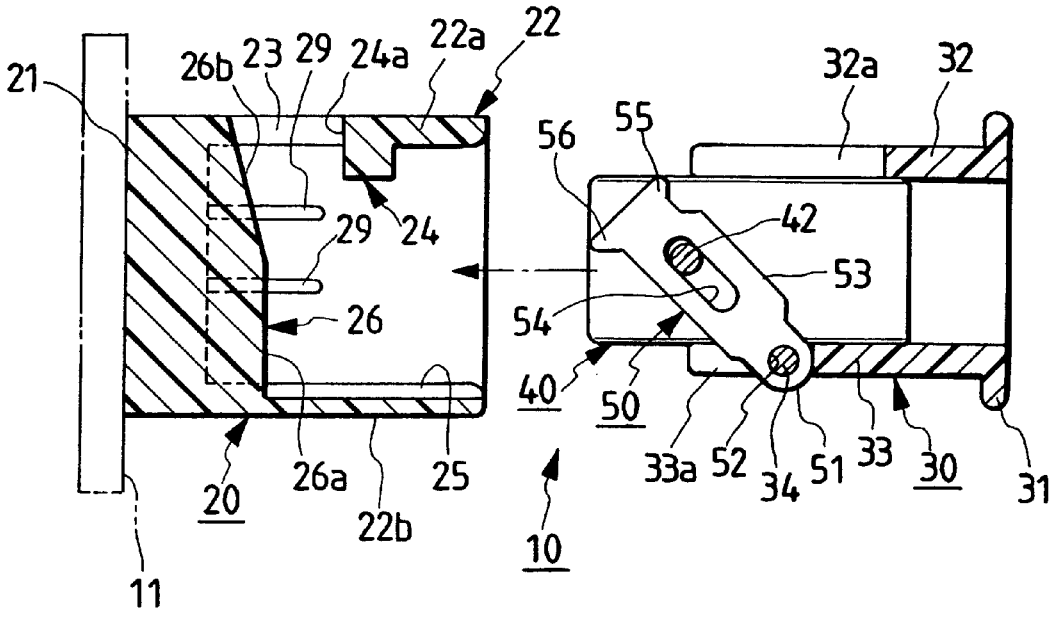
FIG. 1 is a cross-sectional view showing a state where a slidably attaching type connector according to an embodiment of the invention is about to be attached to a mating connector housing.
Figure 2:
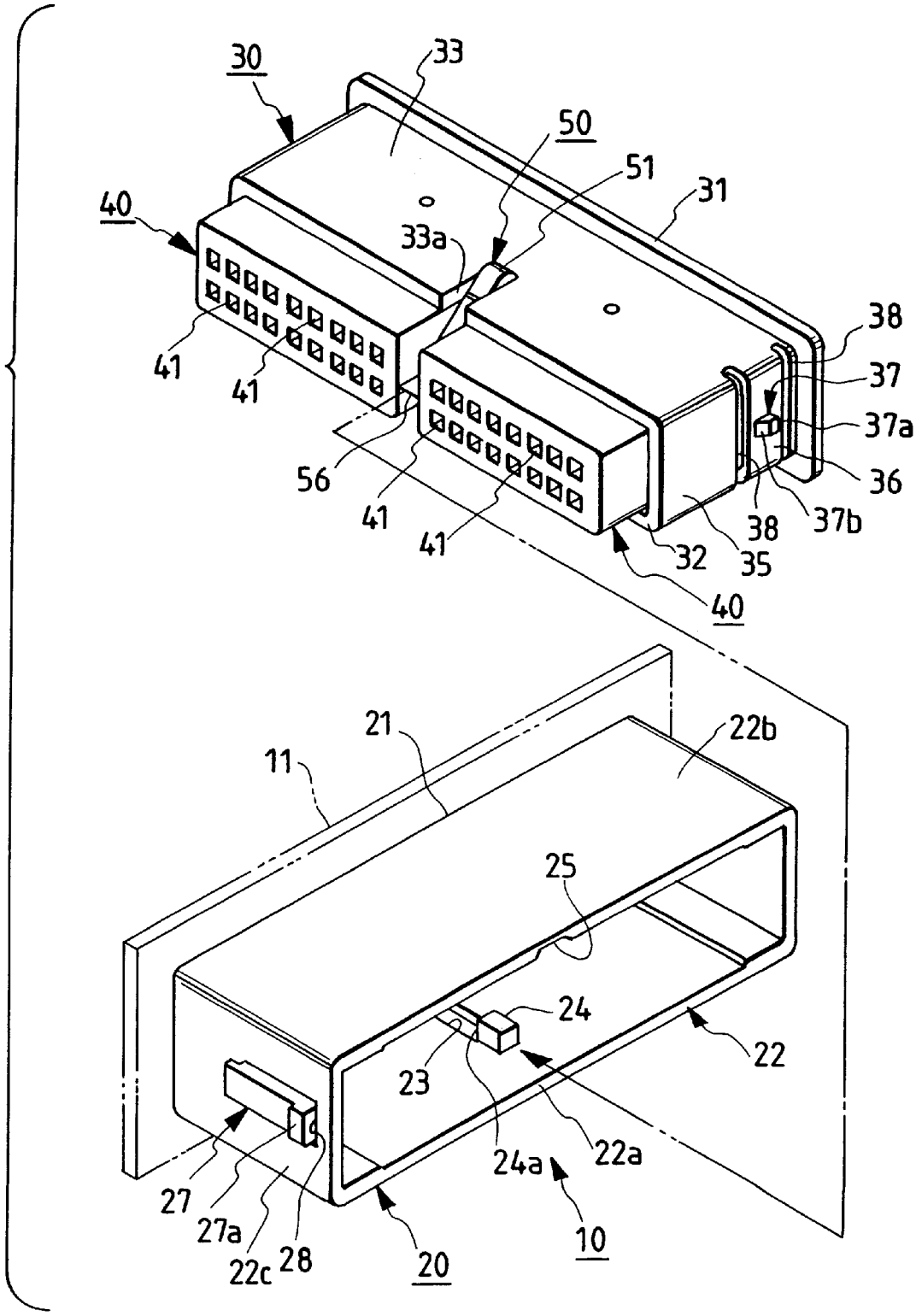
FIG. 2 is an exploded perspective view of a female connector housing and a male connector housing of the slidably attaching type connector according to an embodiment of the invention.

FIG. 1 is a cross-sectional view showing a state where a slidably attaching type connector according to an embodiment of the invention has not been attached yet. FIG. 2 is a perspective view of a female connector housing and a male connector housing of the slidably attaching type connector according to the embodiment viewed from the bottom side thereof where the slidably attaching type connector has not been attached yet.

As shown in FIGS. 1 and 2, a slidably attaching type connector 10 includes a female type connector housing (the other of the connector housings) 20 made from composite resin in which a plurality of male terminals 29 are protruded from a rear wall 21 within a rectangular shaped hood portion 22 and the rear surface side of the rear wall 21 is fixed to a substrate 11; a rounded rectangular-shaped slide cover (slide member) 30 made from composite resin which is free to reciprocally slide within the hood portion 22 of the female type connector housing 20 so as to be attached thereto; a pair of rectangular male type connector housings (the one of the connector housings) 40, 40 made from composite resin which are supported within the slide cover 30 so as to be free to slide reciprocally therein; and a lever 50, made from composite resin and disposed at the center portion of the slide cover 30 between the pair of the male type connector housings 40, 40. The lever 50 swings or rotates in accordance with the reciprocal slide movement of the slide cover 30, thereby assisting the male type connector housings 40, 40 on the movable side to attach to and detach from the female type connector housing 20 as a result of leverage between a point of force at one end of the lever, a point of action at an intermediate portion of the lever and the fulcrum at the other end of the lever.

An opening portion 23 is formed at the center portion of an upper wall 22*a* of the hood portion 22 of the female type connector housing 20. A block-shaped protrusion portion (one engaging portion) 24 is integrally formed on the inner surface of the upper wall 22*a* of the hood portion 20 at the front end of the opening portion 23 so as to protrude from the upper wall. The rear surface of the protrusion portion 24 and the front end surface of the opening portion 23 form an engaging surface 24*a*. A groove-shaped concave portion (lever guide portion) 25 is formed at the center portion on the inner side of the lower wall 22*b* of the hood portion 22 of the female type connector housing 20 so as to extend from the front end of the lower wall to the rear wall 21. A rib (the other engaging portion) 26 is integrally formed on the rear wall 21 at the center portion of the inner side of the rear wall 21 opposite to the opening portion 23 so as to extend from the rear end of the concave portion 25 and protrude from the rear wall 21. The rib 26 forms a flat surface 26*a* extending from the concave portion 25 side to the center portion and a tapered surface (slanted surface) 26*b* extending from the center portion to the opening portion 23.

As shown in FIGS. 2, and 5A to 5C, a substantially L-shaped flexible release arm (release member) 27 is integrally formed at the center portion of the side wall 22*c* of the hood portion 22 of the female type connector housing 20 so as to protrude from the side wall. The portion of the wall portion 22 opposite from the base portion of the release arm 27 where the release arm connects to the wall portion 22*c* is notched in a U-shape to form an engaging hole (engaging portion) 28. When a pressing portion 27*a* at the outer front side of the release arm 27 is pressed, a front end corner portion (release portion) 27*b* of the release arm protrudes toward the inside of the hood portion (that is, the engaging hole 28 side).

Figure 3:
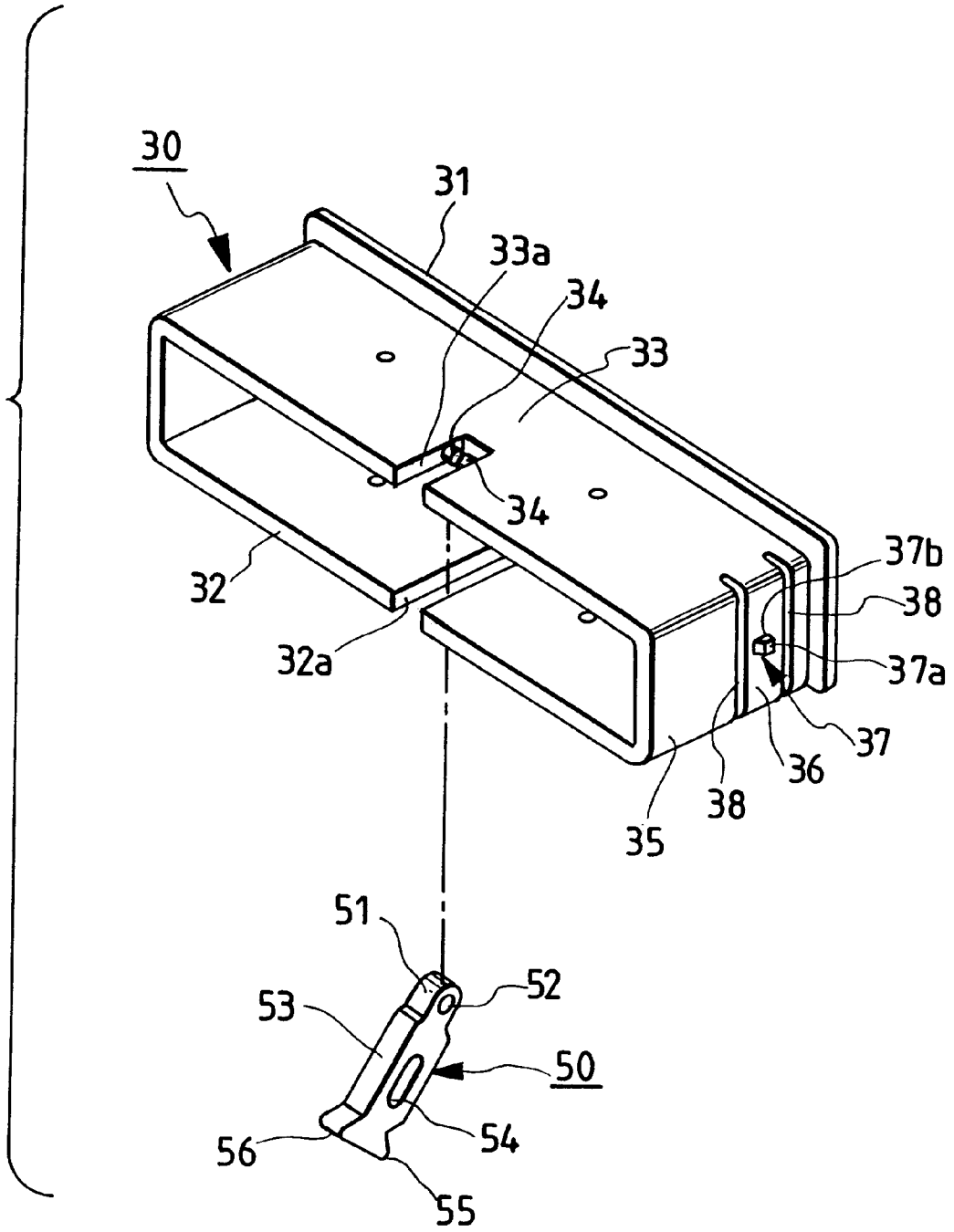
FIG. 3 is a perspective view from the bottom side of a slide cover to be received within the male type connector housing and a lever rotatably supported by the slide cover.

As shown in FIGS. 2 and 3, the slide cover 30 is formed in a rounded rectangular shape and made from composite resin. The male type connector housings 40, 40 are mounted within the slide cover 30 so as to be freely slidable therein. The slide cover 30 is free to slide within the hood portion 22 of the female type connector housing 20 at the time of detaching the connector housings 20, 40. An annular operation portion 31 is integrally formed at the front end side along the outer periphery of the rounded rectangular slide cover 30. A long slit 32*a* and a short slit 33*a* are formed at the center portions of the upper wall 32 and the lower wall 33 of the slide cover 30 so as to oppose to each other, respectively. A pair of pivots 34, 34 for rotatably supporting the base end portion 51 of the lever 50 are integrally formed on the opposed inner surfaces of the lower short slit (one slit) 33*a*. The tip end side of the lever 50 is free to be inserted within and separate from the upper side long slit (the other slit) 32*a*.

Figure 5A:
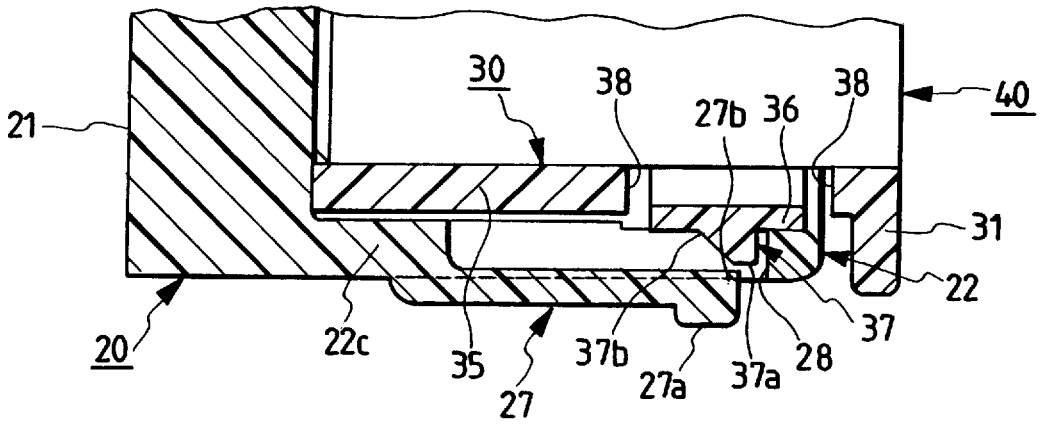
FIG. 5A is a cross sectional view showing the locked state of the female type and male type connector housings of the slidably attaching type connector at the time of attaching them.
Figure 5B:
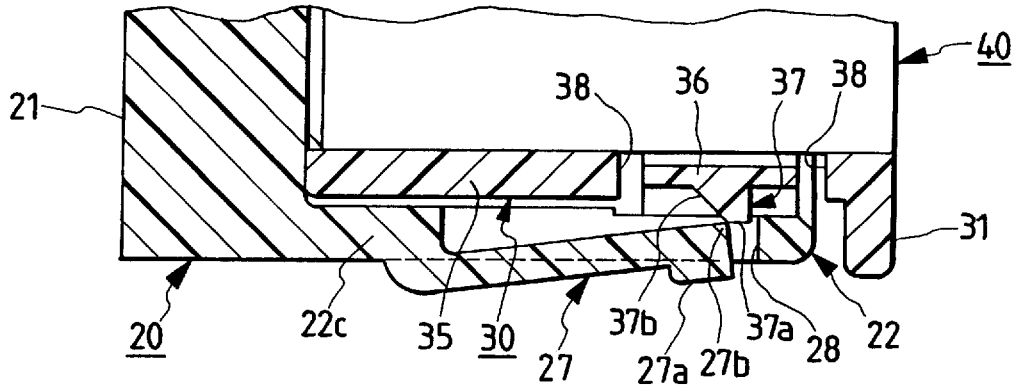
FIG. 5B is a cross sectional view showing the state where the female type and male type connector housings are being unlocked.

A flexible arm (flexible member) 36 is integrally formed at the center front side of the wall 35 of the slide cover 30. The flexible arm 36 with a thin thickness is integrally formed on the front side of the side wall 35 of the slide cover 30 between a pair of notch portions 38, 38 formed in parallel in the side wall 35 in a manner that the flexible arm 36 is flexible toward the inside of the slide cover 30. An engaging portion 37 having a trapezoidal cross-section is integrally formed at the center portion of the flexible arm 36 so as to protrude therefrom. A tapered surface 37*b* is formed on the female type connector housing 20 side of the engaging portion 37 as shown in FIG. 5A. Normally, the front end corner portion 27*b* of the release arm 27 abuts a flat surface 37*a* of the engaging portion 37, so that the engaging portion 37 of the flexible arm 36 engages with the engaging hole 28 on the release arm 27 side and hence the attached state of the connector housings 20, 40 is freely locked. When the pressing portion 27*a* of the release arm 27 is pressed, the front end corner portion 27*b* of the release arm 27 pushes the flat surface 37*a* of the engaging portion 37 to bend the flexible arm 36 toward the inside of the slide cover 30, thereby abutting the front end corner portion 27*b* of the release arm 27 against the tapered surface 37*b* of the engaging portion 37. As a consequence, the engaging state (locked state) between the engaging portion 37 of the flexible arm 36 and the engaging hole 28 on the release arm 27 side is released, and further the slide cover 30 is moved so that it slightly protrudes outside with respect to the female type connector housing 20 and the male type connector housing 40, so that the slide cover 30 can be easily extracted.

As shown in FIG. 2, each of the male type connector housings 40 is made from composite resin and formed in a substantially rectangular shape, and includes a plurality of terminal receiving chambers 41 between the front and rear surfaces thereof. Each of the terminal receiving chambers 41 contains therein a not-shown female terminal which is electrically connected to the corresponding male terminal 29 of the female type connector housing 20, thereby electrically connecting the connector housings 20, 40 to each other at the time of attaching the connector housings 20, 40. A not-shown wire harness is connected to each of the not-shown female terminals. The lever 50 is provided between the pair of the male type connector housings 40, 40. That is, a cylindrical support pin (action point portion) serving as an action point of the lever 50 is formed at the front side of the center portion of the opposing side surfaces of the male type connector housings 40, 40 through integral-forming, pressing insertion or the like so as to protrude therefrom.

The lever 50 is made from composite resin and formed in a substantially rectangular plate shape, and has a round hole 52 at the center portion of the arc-shaped base end portion 51 thereof. The pair of pivots 34, 34 of the short slit 33*a* at the lower side of the slide cover 30 are fitted into the round hole 52 thereby to rotatably support the base end portion 51 of the lever 50. A slot (action point receiving portion) 54 is formed at the intermediate portion 53 of the lever 50. The slot 54 is slidably engaged with the support pin 42 of the male type connector housing 40. The tip side of the lever 50 is arranged to form a pair of tip portions 55, 56 protruded in a substantially triangular plate shape to the front and rear sides, respectively. The tip portion (one tip portion) 55 on the forward side is free to attach to and detach from the protrusion portion 24 serving as the one engaging portion of the female type connector housing 20. The tip portion (the other tip portion) 56 on the rear side is free to attach to and detach from the rib 26 serving as the other engaging portion of the female type connector housing 20. Further, the lever 50 is formed in a manner that the distance from the base end portion 51 of the lever to the intermediate portion 53 pivotally supported by the support pin 42 of the male type connector housings 40 is longer than the distance from the intermediate portion 53 to the tip portions 55, 56.

Figure 4A:
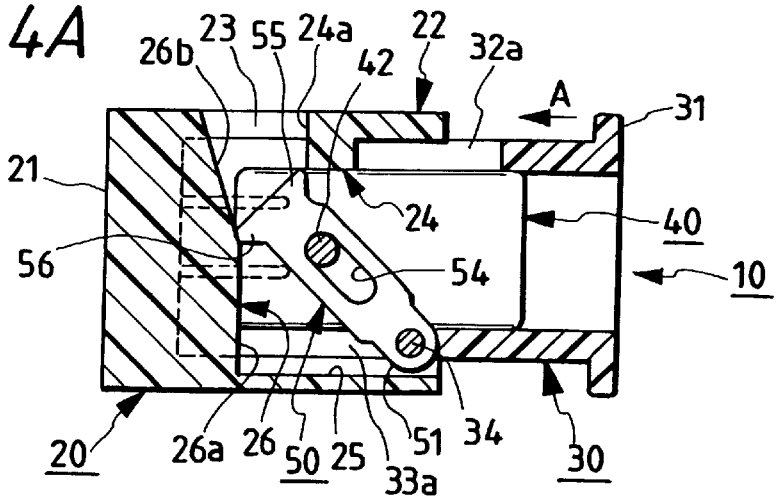
FIG. 4A is a cross sectional view of the female type and male type connector housings at the time of starting the attaching operation therebetween.

According to the slidably attaching type connector 10 of the embodiment described above, in the state where the female type connector housing 20 and the male type connector housings 40 have not been attached to each other yet (that is, detached state), the lever 50 is placed in a slanted state between the pivot 34 of the slide cover 30 and the support pin 42 of the male type connector housings 40, as shown in FIGS. 1 and 2. In this state, the tip portion side of the slide cover 30 receiving the male type connector housings 40 is inserted within the hood portion 22 of the fixed side female type connector housing 20 thereby to provisionally attach the slide cover 30 to the connector housing 20 as shown in FIG. 4A. Then, if the slide cover 30 is pushed toward such a direction that the female type connector housing 20 and the male type connector housings 40 are attached to each other (that is, a forward direction shown by an arrow A in FIG. 4A), the tip portion 56 of the rear side of the lever 50 at first contacts to the flat surface 26*a* of the rib 26 within the hood portion 22 of the female type connector housing 20 and then contacts to the tapered surface 26*b* thereof. Thus, only the lever 50 rotates due to the initial forward movement of the slide cover 30, so that the tip end portion 55 of the front side of the lever 50 protrudes upward from the opening portion 23 of the female type connector housing 20. As a consequence, the tip end portion 55 of the front side of the lever 50 abuts against the engaging portion 24*a* of the protrusion portion 24 to form the fulcrum as shown in FIG. 4A.

Figure 4B:
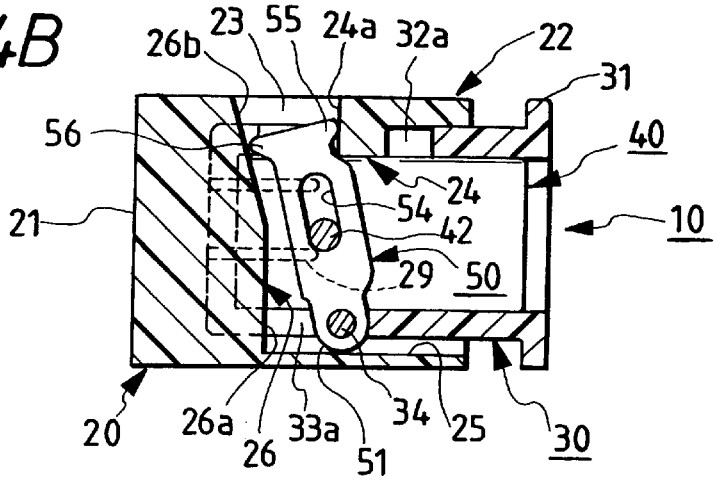
FIG. 4B is a cross sectional view of the female type and male type connector housings during the attaching operation therebetween.
Figure 4C:
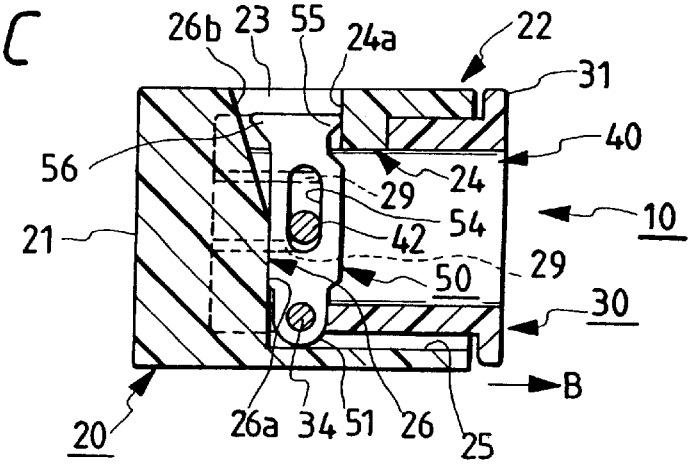
FIG. 4C is a cross sectional view of the female type and male type connector housings at the time of completing the attaching operation therebetween.

In this state, if the slide cover 50 is further pushed toward the forward direction, as shown in FIG. 4C, the male type connector housings 40 are drawn into the hood portion 22 of the female type connector housing 20 by the leverage of the lever 50 (that is, the leverage in which the round hole 52 of the base end portion 51 of the lever 50 serves as a force applying point, the support pin 42 of the male type connector housing 40 serves as a point of action, and the tip portion 55 of the front side of the lever 50 serves as a fulcrum), so that both connector housings 20 and 40 are attached to each other. In this case, as shown in FIG. 5A, since the engaging portion 37 of the slide cover 30 engages with the engaging hole 28 of the female type connector housing 20, the attached state of the both connector housings 20 and 40 are locked. The slide cover 50 moves or slides smoothly without fluctuation until the engaging portion 37 of the slide cover 30 is locked within the engaging hole 28 of the female type connector housing 20 since the base end portion 51 of the lever 50 moves along the recess portion 25 of the female type connector housing 20.

Figure 5C:
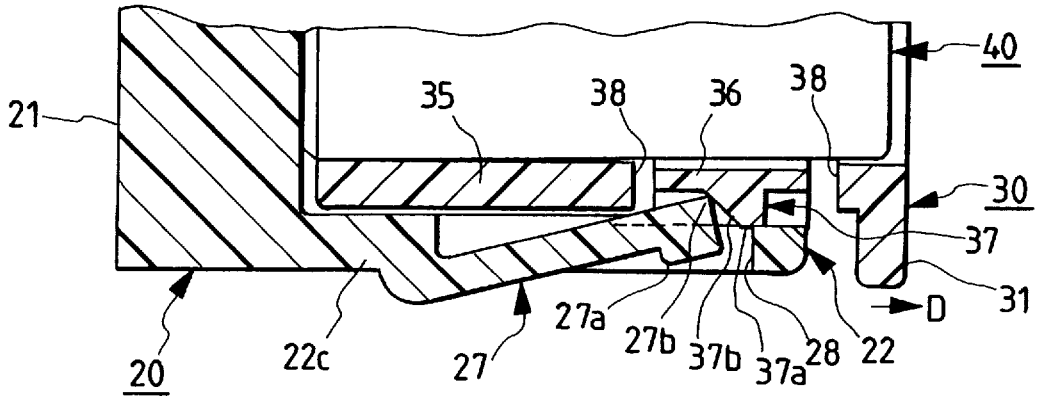
FIG. 5C is a cross sectional view showing the state where the unlocking operation of the female type and male type connector housings has been completed.
Figure 6A:
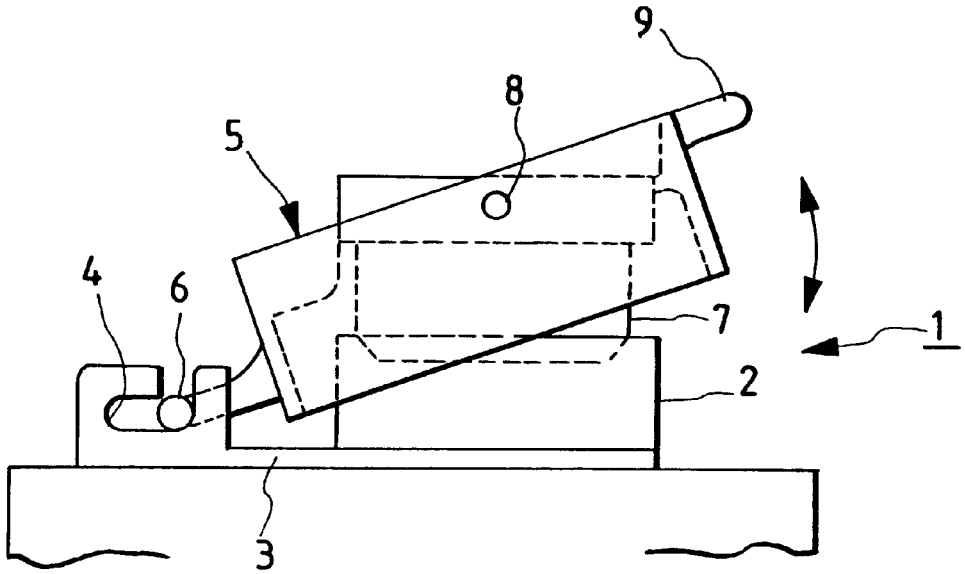
FIG. 6A PRIOR ART
FIG. 6A is a explanatory diagram of an example of the conventional lever type connector.
Figure 6B:
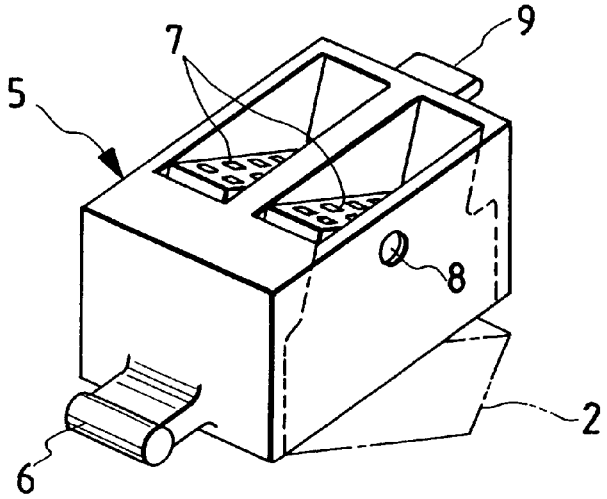
FIG. 6B PRIOR ART
FIG. 6B is a perspective view of the conventional lever type connector seen from the lever side thereof.

At the time of releasing the locking of the attached state, if the pressing portion 27*a* of the release arm 27 of the female type connector housing 20 is pushed, the flat portion 37*a* of the engaging portion 37 of the slide cover 30 is pushed by the front end corner portion 27*b* of the release arm 27, as shown in FIG. 5A. Then, the flexible arm 36 of the slide cover 30 is bent inside thereof, so that the pressing portion 27*a* of the release arm 27 abuts against the tapered surface 37*b* of the engaging portion 37. As a result, as shown in FIG. 5C, the locked state between the engaging portion 37 of the flexible arm 36 and the engaging hole 28 of the release arm 27 side is released. Further, the slide cover 30 is pushed slightly outside (that is, a direction shown by an arrow D in FIG. 5C) with respect to the female type connector housing 20 and the male type connector housing 40, so that the slide cover 30 can be easily extracted. In this state, at the time of detaching the male type connector housing 40 from the female type connector housing 20, if the slide cover 30 is drawn to the reverse direction (that is, a direction shown by an arrow B in FIG. 4C), both the connector housings 20 and 40 are detached from each other by the leverage of the lever 50 (that is, the leverage in which the round hole 52 of the base end portion 51 of the lever 50 serves as a force applying point, the support pin 42 of the male type connector housing 40 serves as a point of action, and the tip portion 56 of the rear side of the lever 50 serves as a fulcrum) in accordance with the drawing of the slide cover 30 in a manner that the tip end portion 56 of the rear side of the lever 50 abuts against the tapered surface 26*b* of the rib 26 and serves as a fulcrum.

In this manner, the slide cover 30 is provided so as to be free to slide reciprocally in opposite directions such that both the connector housings are attached and detached. Further, when the slide cover 30 moves to the forward direction, the tip portion 55 of the front side of the lever 50 abuts against the engaging portion 24*a* of the protrusion portion 24 of the female type connector housing 20 to draw the male type connector housings 40, 40 into the female type connector housing 20, thereby mutually attaching the connector housings 20, 40. Furthermore, when the slide cover 30 moves to the reverse direction, the tip portion 56 of the rear side of the lever 50 abuts against the tapered surface 26*b* of the rib 26 of the female type connector housing 20, thereby mutually detaching the connector housings 40, 40 from the connector housing 20. According to such an arrangement, the attaching and detaching operation between the connector housings 20 and 40, 40 can be performed easily by merely sliding the slide cover 30 to the attaching and detaching direction with a small operation force. In particular, at the time of attaching the connector housings 20 and 40, 40, the attaching operation can be performed by merely pushing the slide cover 30 to the attaching direction. Accordingly, even in the case of attaching the male connector housings to the female connector housing on the fixed side in a small mounting space or the like where the female connector housing can not be seen, for example, both the connector housings 20 and 40, 40 can be attached to each other smoothly in a short time period without requiring skilled operation.

Further, since the lever 50 is arranged so as to be contained within the slide cover 30 and not to protrude outside thereof, the breakage of the lever 50 due to the external load forces or the like being applied thereto can be surely prevented. Accordingly, the attaching and detaching operation between the connector housings 20 and 40, 40 can be performed surely and easily always in a stable state without spoiling the leverage function (that is, attaching function with a small operation force) of the lever 50. Furthermore, since the length of the lever 50 can be made shorter as much as possible, the entire size of the connector can be made smaller in accordance with the shortened length of the lever 50. Furthermore, due to the leverage of the single lever 50 provided at the center portion of the slide cover 30, the attaching and detaching operation between the multi-pole female type and male type connector housings 20 and 40, 40 can be performed surely and easily, and further the number of the parts of the connector can be reduced thereby to reduce the entire cost of the connector.

Although, in the aforesaid embodiment, only a single lever is provided at the center portion of the slide cover, the invention is not limited thereto, and the present invention may be arranged to provide two or more levers. Further, although, in the aforesaid embodiment, the lever is provided at the male type connector housing side, the invention is not limited thereto, and the invention may be arranged to provide the lever at the female type connector housing side.

As described above, according to an aspect of the invention, the leverage achieved by the lever being interlocked with the slide member enables the attaching and detaching operation between the male type and female type connector housings to be performed easily by merely sliding the slide member to the attaching and detaching direction with a small operation force.

According to another aspect of the invention, since the lever is arranged so as to be contained within the slide member and not to protrude outside thereof, breakage of the lever resulting from an external load force or the like applied thereto can be surely prevented. Accordingly, the attaching and detaching operation between the male type and female type connector housings can be performed surely and easily always in a stable state without spoiling the leverage of the lever.

An additional benefit of the invention is that the length of the lever can be made shorter and the entire size of the connector can be made smaller in accordance with the shortened length of the lever.

The leverage of the single lever provided at the center portion of the slide member allows the attaching and detaching operation between the multi-pole female type and male type connector housings to be performed surely and easily will reduce the number of the parts of the connector, thereby reducing the entire cost of the connector.

A potential disadvantage of the above-described embodiment is described with reference to FIGS. 14–17, which are similar to FIGS. 4A–4C. A slide member 103 is reciprocally slidably disposed on a male connector housing 102 constituting one of the connector housings of a slidably fitting type connector 101. A base end portion 104*a* of a lever 104 which is rotated by reciprocal movement of the slide member 103 is rotatably supported on the slide member 103 via a support shaft 105. A slot 104*b* in an intermediate portion of the lever 104 is linked with a support pin 106 of the male connector housing 102 and serves as a point of action. In order that the male connector housing 102 is fitted to and detached from a female connector housing 107 constituting another connector housing, tip portions 104*c* and 104*d* of the lever 104 are engageable with and detachable from a pair of engaging portions 108 and 109 of the female connector housing 107, respectively.

When the slide member 103 is moved forward, the tip portion 104*c* of the lever 104 is engaged with the one engaging portion 108 of the female connector housing 107, and the male connector housing 102 is pulled into the female connector housing 107, so that the connector housings 102 and 107 are fitted to each other. When the slide member 103 is moved rearwardly, the tip portion 104*d* of the lever 104 is engaged with the other engaging portion 109 of the female connector housing 107, so that the connector housings 102 and 107 are separated from each other. As shown in FIGS. 14–17, specifically, the slide member 103 is pushed in the forward direction (fitting direction) so as to be gradually squeezed into the female connector housing. Then, the leverage action (in which the support shaft 105 of the base end portion 104*a* of the lever 104 serves as a point of force, the support pin 106 of the male connector housing 102 serves as a point of action, and the tip portion 104*c* of the lever 104 serves as a fulcrum) of the lever 104 causes the male connector housing 102 to be pulled into a hood portion 107*a* of the female connector housing 107, thereby fitting the connector housings 102 and 107 to each other.

In the slidably fitting type connector 101 described above, when the connector housings 102 and 107 are to be fitted to each other, the tip portion 104*c* of the lever 104 is used as the fulcrum of the leverage action. When the lever 104 is rotated in order to fit the connector housings 102 and 107 to each other, therefore, the tip portion 104*c* of the lever 104 serving as the fulcrum is moved in accordance with the rotation of the lever 104, along the one engaging portion 108 of the female connector housing 107 and in the vertical direction of the engaging portion. This increases the distance between the point of action (the support pin 106) and the fulcrum (The tip portion 104*c* of the lever 104), ani reduces the distance between the point of action (the support pin 106) and the point of force (the support shaft 105). Consequently, the leverage force of the lever 104 is reduced, thereby limiting the mechanical advantage achieved during the operation of fitting the connector housings 102 and 107 to each other by means of a small operating force on the slide member 103. In other words, the insertion force effect of the connector housings 102 and 107 is lowered.

A second embodiment of the invention solves the above-discussed problem. A slidably fitting type connector according to the second embodiment of the invention maintains good operability in which a fulcrum of a lever is prevented from being moved and the lever sufficiently exerts the leverage action, so that connector housings can be fitted to each other easily and surely by a small operating force on a slide member.

In the slidably fitting type connector, according to the second embodiment of the invention, the work of fitting the connector housings to each other can be easily conducted by sliding the slide member so as to move the slide member (and the male type connector housings) in reciprocal moving directions (fitting and detaching directions). In this case, the fulcrum of the leverage is not moved because the protrusion serving as the fulcrum of the lever which is rotated by the reciprocal movement of the slide member is disposed on the engaging portion of the other connector housing (the female type connector housing). Therefore, the lever sufficiently exerts the leverage action by a small operating force on the slide member, so that the connector housings can be fitted to each other smoothly and surely.

In the slidably fitting type connector according to the second embodiment of the invention, the lever is surrounded by the slide member and is not protruded to the outside, and hence the lever is prevented from being damaged by an external load force, etc. According to this configuration, the leverage action of the lever is not impaired and the fitting of the connector housings is always surely conducted in a stable state.

According to another aspect of the second embodiment, the guide portion serving as a portion of a point of action is protruded from the one connector housing (the male connector housings), and the intermediate portion of the lever is slidable with respect to the guide portion.

In the slidably fitting type connector according to the second embodiment, the portion of the point of action is configured by a simple structure in which the guide portion is protruded from the one connector housing, and hence the whole of the connector can be miniaturized and the production cost can be reduced.

Figure 7:
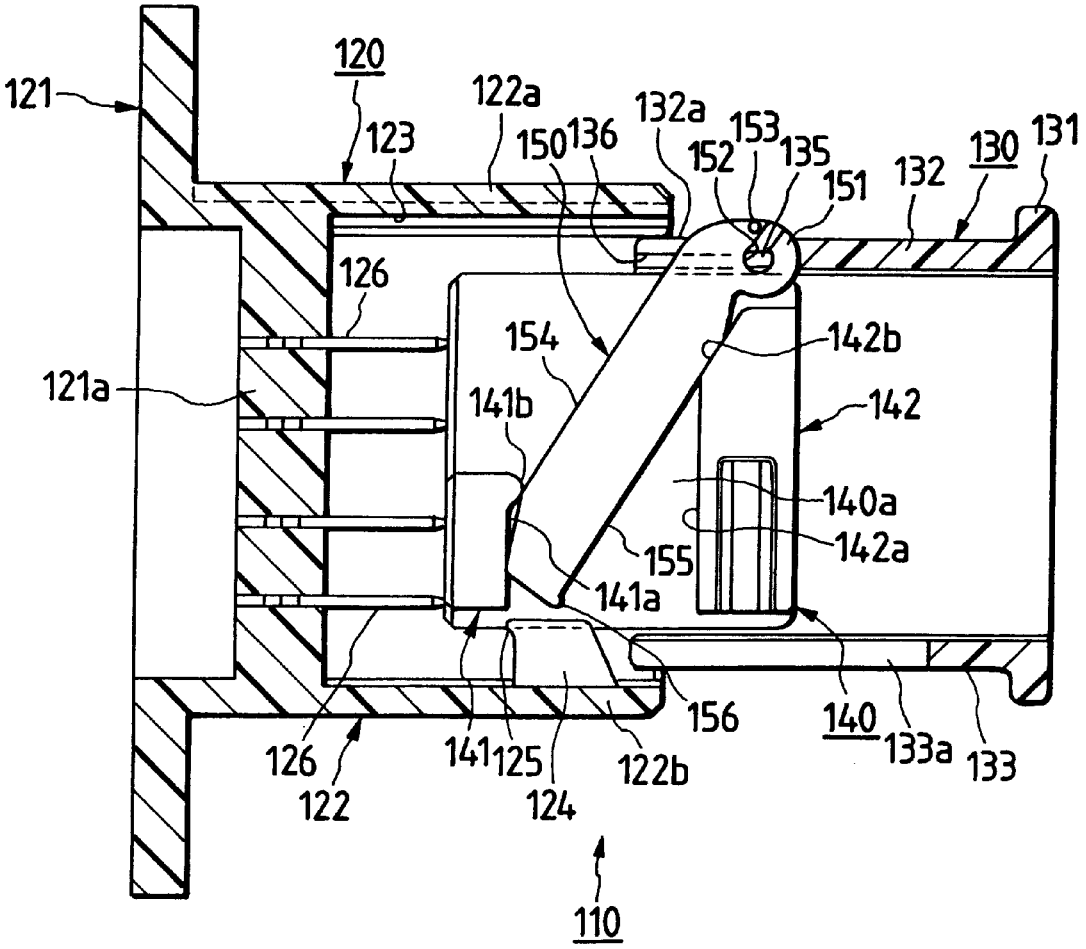
FIG. 7 is a section view showing a state immediately before start of fitting of a slidably fitting type connector according to the second embodiment of the invention.
Figure 8:
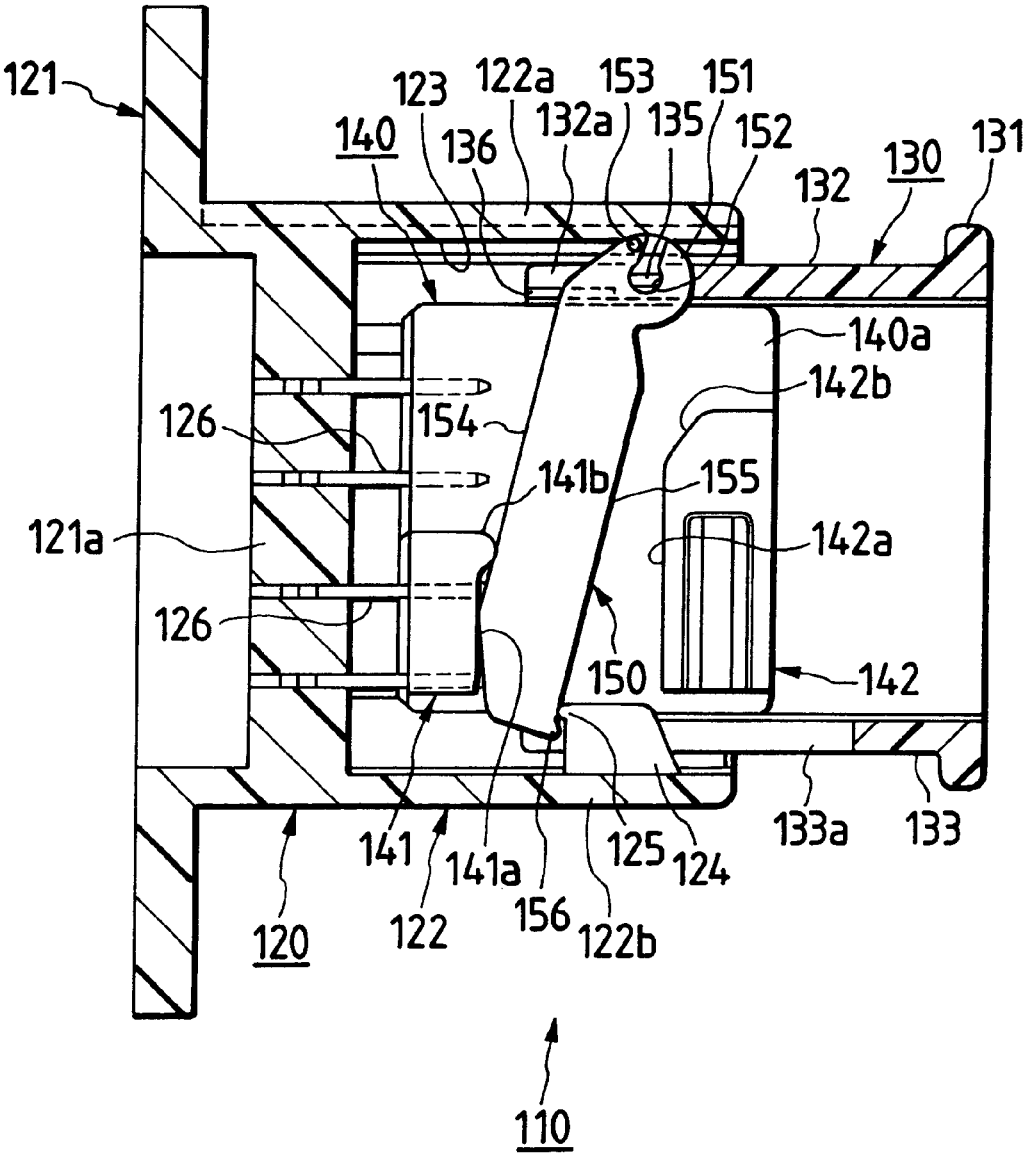
FIG. 8 is a section view showing a state in the course of fitting of the slidably fitting type connector as shown in FIG. 7.
Figure 9:
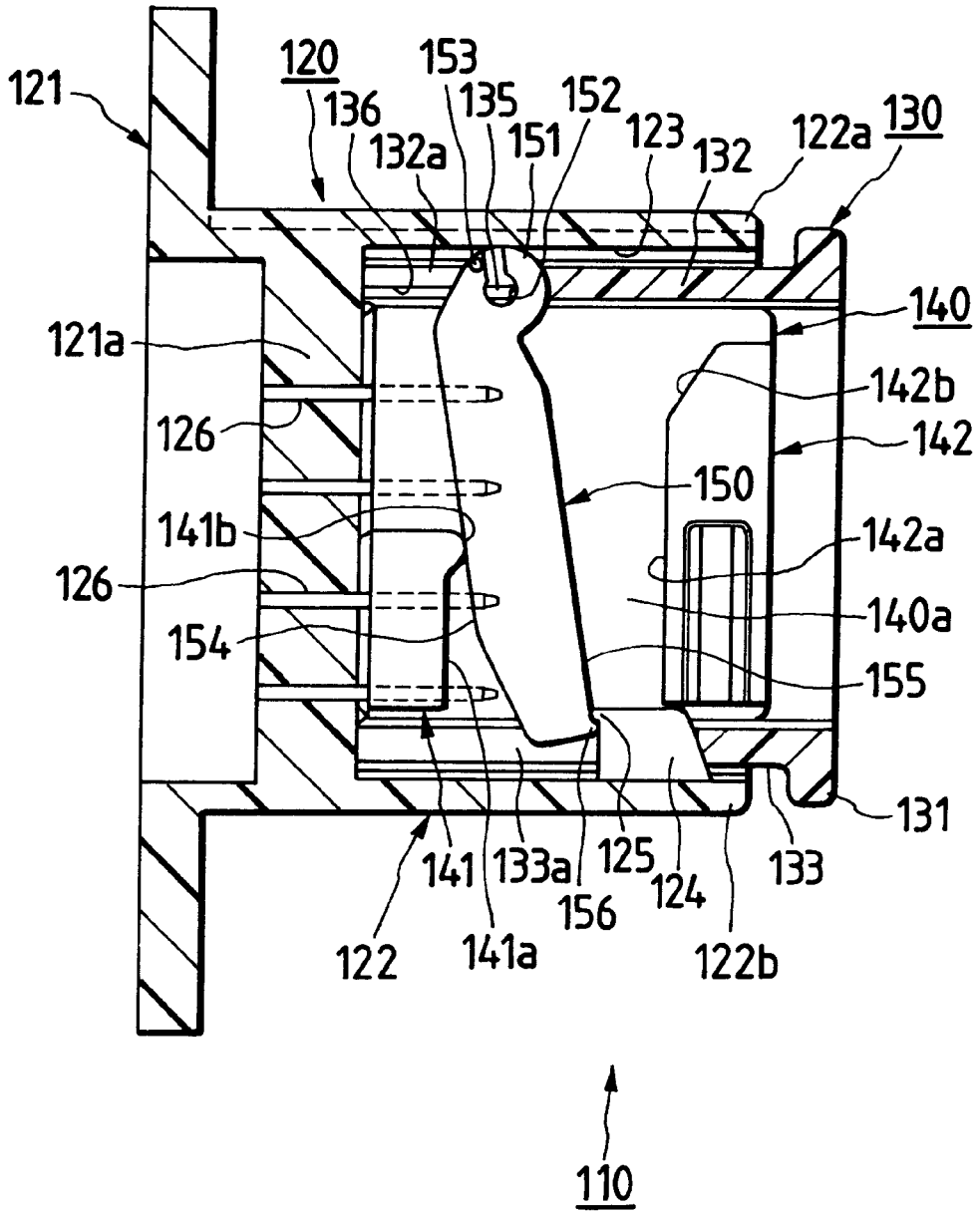
FIG. 9 is a section view showing a state in which fitting of the slidably fitting type connector has been completed.

As shown in FIGS. 7–9, the slidably fitting type connector 110 according to the second embodiment of the invention includes a female connector housing (other connector housing) 120 made of a synthetic resin in which plural male terminals 126 are protruded from a recess 121*a* of a rear wall 121 into a rectangular cylindrical hood portion 122. The rear face side of the rear wall 121 is fixed to a substrate (not shown). A slide cover (slide member) 130 made of a synthetic resin which has a rounded rectangular shape is to be loosely fitted into the hood portion 122 of the female connector housing 120 in a reciprocally slidable manner. A male connector housing (one connector housing) 140 made of a synthetic resin and having a rectangular parallelpiped shape and which is supported in the slide cover 130 in a reciprocally slidable manner. A lever 150 made of a synthetic resin is disposed between upper and lower walls 32 and 33 of the slide cover 130 and swings (or rotates) in accordance with the reciprocal slide movement of the slide cover 130, thereby fitting the male connector housing 140 on the movable side into the female connector housing 120 on the stationary side by means of the leverage action.

As shown in FIGS. 7–9, a groove-like recess (lever guide portion) 123 which elongates from the front end of the hood portion 122 of the female connector housing 120 to the recess 121*a* of the rear wall 121 is formed in the inner face of the upper wall 122*a* of the hood portion 122. A rib (engaging portion) 124 is integrally protruded from the front side of the inner face of the lower wall 122*b* of the hood portion 122 of the female connector housing 120. A protrusion 125 over which the tip portion of the lever 150 slides is integrally protruded from the upper end of the rear face of the rib 124. When the male connector housing 140 is to be pulled into the female connector housing 120 by a reciprocal sliding operation of the slide cover 130 so as to fit the connector housings 120 and 140 to each other, the tip portion of the lever 150 slidably abuts against the protrusion 125 so that the protrusion serves as a fulcrum for the lever 150.

As shown in FIGS. 7–13, the slide cover 130 is made of a synthetic resin and formed into a rounded rectangular shape, and slidably outward attached to the male connector housing 140. When the connector housings 120 and 140 are fitted to and detached from each other, the slide cover 130 is slidable within the hood portion 122 of the female connector housing 120. An annular flange-like operation portion 131 is integrally protruded from the front end of the outer peripheral face of the rounded rectangular slide cover 130. Slits 132*a* and 133*a* are formed in opposed positions of the upper and lower walls 132 and 133 of the slide cover 130, respectively. The base end portion 151 of the lever 150 is rotatably supported in the slit (one slit) 132*a* of the upper wall 132 via a support shaft 135 for a point of force. The tip of the lever 150 can be inserted into and separated from the slit (other slit) 133*a* of the lower wall 133. A groove (engaging portion) 136 with which provisional fixing means 153 (described later) disposed on the side of the base end portion 151 of the lever 150 is to be provisionally engaged is recessedly formed in the front side of each of the opposed inner faces of the slit 132*a* of the upper wall 132.

As shown in FIGS. 7–13, the male connector housing 140 is made of a synthetic resin and formed into a substantially rectangular parallelpiped shape. A plurality of terminal receiving chambers (not shown) are formed between the front and rear faces of the housing. The terminal receiving chambers respectively house female terminals which are not shown and which, when the connector housings 120 and 140 are fitted to each other, are electrically connected to the male terminals 126 of the female connector housing 120 so as to attain the electrical connection between the connector housings 120 and 140. The female terminals are connected to a wire harness which is not shown. A guide portion (portion of a point of action) 141 having a rectangular parallelpiped shape is integrally protruded from the front lower side of one side face 140*a* of the male connector housing 140. An arcuate protrusion 141*b* over which an intermediate portion of the lever 150 slides so that the protrusion serves as a point of action is integrally protruded from an upper portion of the rear face 141*a* of the guide portion 141.

Figure 12:
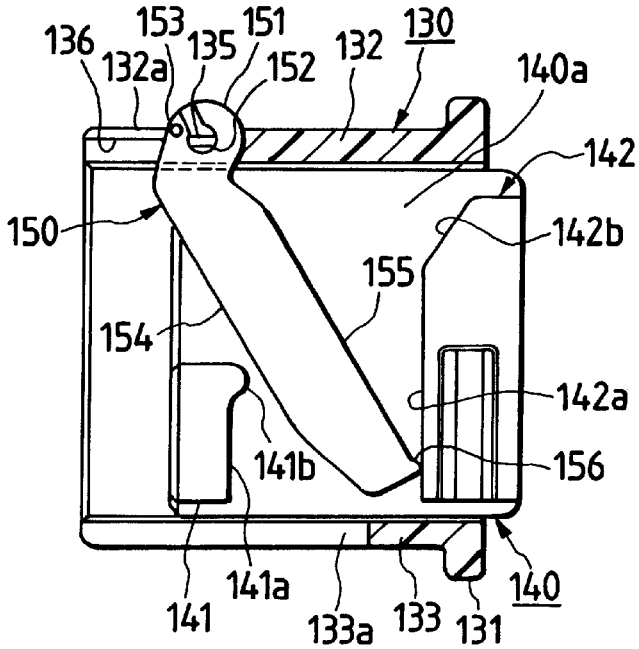
FIG. 12 is a section view showing a state where the course of attachment of the male connector housing and the slide member is started.
Figure 13:
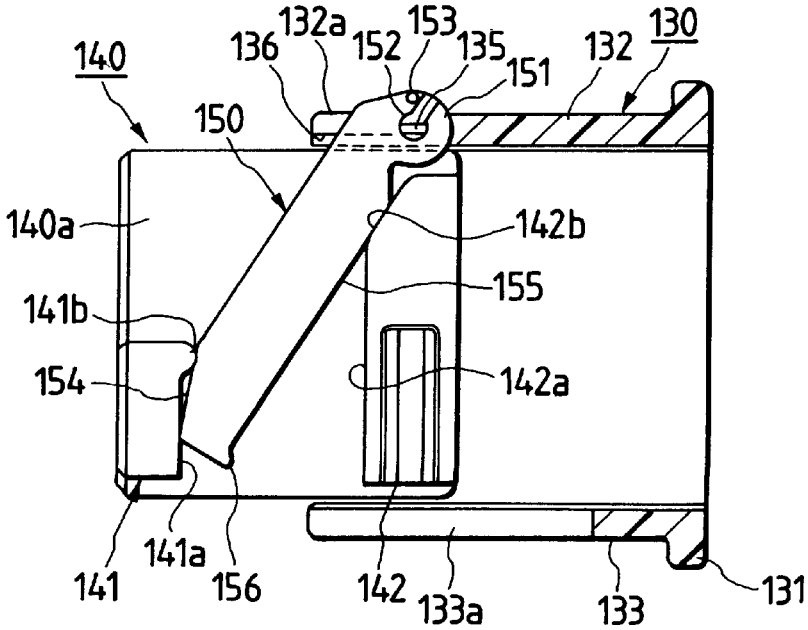
FIG. 13 is a section view showing a state in which attachment of the male connector housing and the slide member has been completed.

As shown in FIGS. 12 and 13, a lever pushing portion 142 which has a substantially rectangular parallelpiped shape and over which a sliding contact portion 156 (described later) on the tip side of the lever 150 contactingly slides is integrally protruded from the rear side of the one side face 140*a* of the male connector housing 140. The lever pushing portion 142 comprises: a front face (guiding face) 142*a* over which the sliding contact portion 156 of the lever 150 slides; and a taper face (regulating face) 142*b* which is formed continuously with the upper side of the front face 142*a* to guide the lever 150 to a normal position. When the sliding contact portion 156 on the tip side of the lever 150 pressingly slides over the front face 142*a* of the lever pushing portion 142 as shown in FIGS. 12 and 13, the provisional locking state of the lever 150 is cancelled. When the slide cover 130 is completely attached to the male connector housing 140 as shown in FIG. 7, the lever 150 is guided via the taper face 142*b* of the lever pushing portion 142 to the normal position (initial position of rotation).

As shown in FIGS. 7–13, the lever 150 is made of a synthetic resin and formed into a substantially rectangular plate-like shape. A pivot hole (engaging portion) 152 is formed at the center of an arcuate base end portion 151 of the lever. The support shaft 135 which protrudes into a slit 132*a* of the upper wall 132 of the slide cover 130 is fitted into the pivot hole 152, whereby the base end portion 151 of the lever 150 is rotatably supported. The provisional fixing protrusion (provisional fixing means) 153 which has a horizontal column-like shape and which is to be provisionally fixed to the groove 136 of the slide cover 130 is integrally protruded from the vicinity of the pivot hole 152 in the side faces of the lever 150.

In the front face (one face) 154 of the lever 150, an area which extends from the intermediate portion to the tip portion is formed as a taper face. The front face 154 can be slidingly contacted with the arcuate protrusion 141*b* of the guide portion 141 of the male connector housing 140. Moreover, the upper side of the rear face (other face) 155 of the lever 150 can abut against the taper face 142*b* of the lever pushing portion 142 of the male connector housing 140. The slidingly contacting portion 156 having a substantially triangular prism-like shape is integrally protruded from the tip of the rear face 155 of the lever 150. When the slidingly contacting portion 156 pressingly slides to the lower side of the front face 142*a* of the lever pushing portion 142 of the male connector housing 140 as shown in FIG. 13, the provisional locking state of the lever 150 is cancelled. When the female and male connector housing 120 and 140 are to be fitted to each other by a reciprocal sliding operation of the slide cover 130, the rear face 155 of the lever 150 which is on the side of the slidingly contacting portion 156, slides over the protrusion 125 for the lever fulcrum and protruding from the rib 124 of the female connector housing 120.

Figure 10:
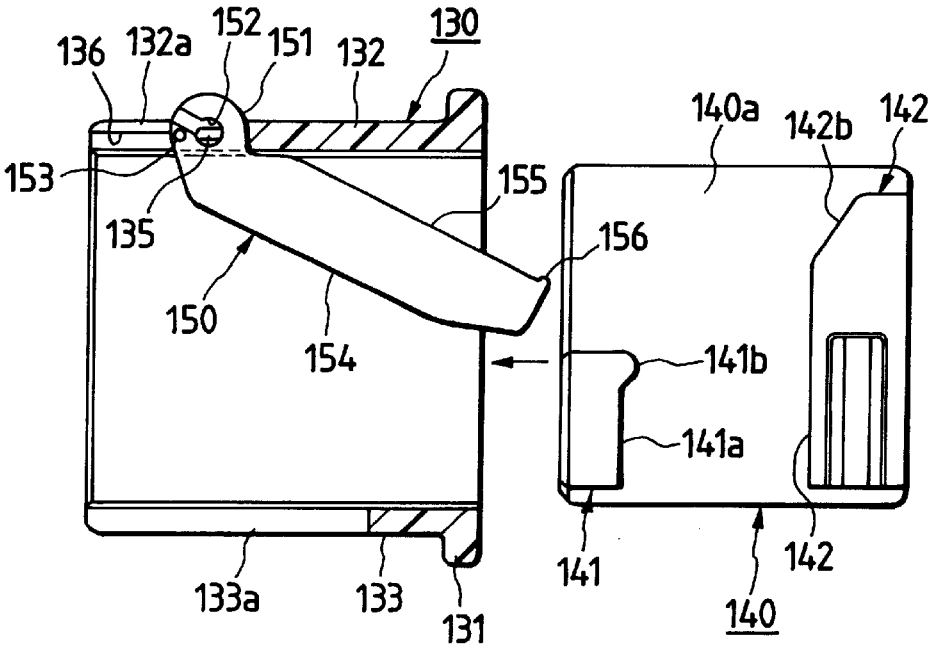
FIG. 10 is a section view showing a state in which a male connector housing of the slidably fitting type connector according to the second embodiment and a slide member to which a lever is provisionally fixed have not been attached to each other.
Figure 11:
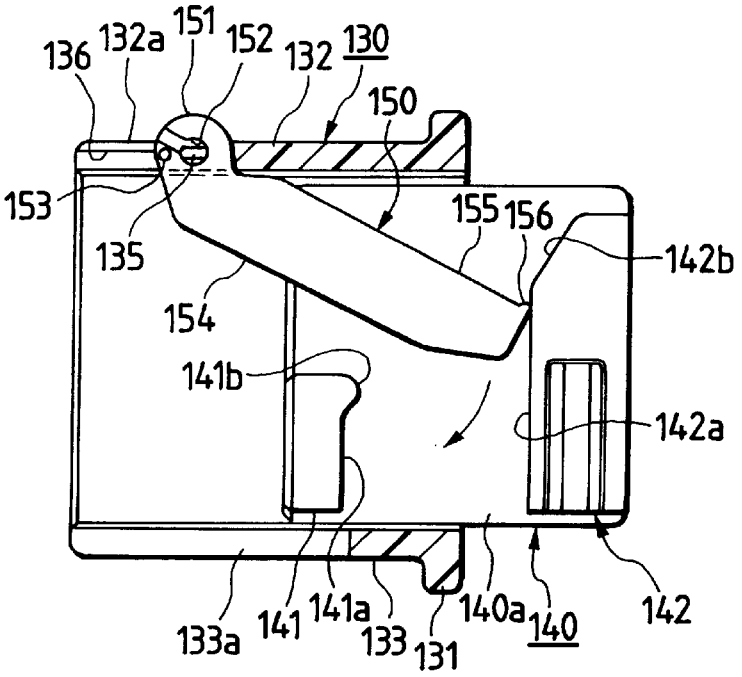
FIG. 11 is a section view showing a state in which attachment of the male connector housing and the slide member is started.

In the slidably fitting type connector 110 of the embodiment, as shown in FIG. 7, immediately before the start of the fitting of the female and male connector housing 120 and 140, the lever 150 is rotatably supported by the support shaft 135 of the slide cover 130, and in a slanted state (the state of the initial position of rotation) and between the protrusion 141*b* of the guide portion 141 of the male connector housing 140 and the taper face 142*b* of the lever pushing portion 142. This state is obtained as assembling the connector as shown in FIGS. 10–13. As shown in FIG. 10, only the lever 150 is set in the slide cover 130 in a state in which a constant angle is maintained. The lever 150 is provisionally fixed in a slanted state by the groove 136 of the upper wall 132 of the slide cover 130 and the provisional fixing protrusion 153 which is provisionally fixed to the groove 136, so as to be prevented from downward hanging. When, under this state, the male connector housing 140 is pressingly inserted into the slide cover 130, as shown in FIG. 11, the sliding contact portion 156 on the tip side of the lever 150 abuts against the front face 142*a* of the lever pushing portion 142 of the male connector housing 140.

When the male connector housing 140 is further pressingly inserted into the slide cover 130, as shown in FIG. 12, the provisional fixing protrusion 153 of the lever 150 is disengaged from the groove 136 of the upper wall 132 of the slide cover 130, and the provisional locking state of the lever 150 is cancelled. When the lever 150 in which the provisional locking state has been cancelled is further pushed by the front face 142*a* of the lever pushing portion 142 of the male connector housing 140, as shown in FIG. 13, the lever 150 is rotated and stopped at the normal position (initial position of rotation) where the front and rear faces 154 and 155 of the lever 150 respectively abut against the protrusion 141*b* of the guide portion 141 of the male connector housing 140, and the taper face 142*b* of the lever pushing portion 142. In this way, the disposition of the provisional fixing protrusion 153 on the lever 150 prevents the lever 150 from being downward directed by its own weight. Therefore, a step of operating the lever 150, such as that of lifting the lever 150 is not required. As a result, the workability of the assembling work of the slide cover 130 and the male corrector housing 140 is improved. Furthermore, the lever 150 is placed at the normal position only by completely attaching the male connector housing 140 into the slide cover 130. Therefore, the work of positioning the lever 150 is not required, and the workability of the assembly work can be further improved.

As shown in FIG. 7, the tip side of the slide cover 130 which surrounds the thus assembled male connector housing 140 is inserted into the hood portion 122 of the female connector housing 120 on the stationary side, and then provisionally fitted to the housing. When the slide cover 130 is thereafter pressed in the fitting direction of the connector housings 120 and 140, as shown in FIG. 8, the tip of the rear face 155 of the lever 150 is contacted with the protrusion 125 for the lever fulcrum and of the rib 124 of the female connector housing 120, so that the lever 150 starts to be rotated. When the slide cover 130 is further pressed in the fitting direction, is shown in FIG. 9, the leverage action of the lever 150 (in which the support shaft 135 which rotatably supports the base end portion 151 of the lever 150 serves as a point of force, the protrusion 141*b* of the guide portion 141 of the male connector housing 140 serves as a point of action, and the protrusion 125 of the rib 124 of the female connector housing 120 serves as a fulcrum) causes the male connector housing 120 to be pulled into the hood portion 122 of the female connector housing 120, thereby fitting the connector housings 120 and 140 to each other.

In this way, the work of fitting the connector housings 120 and 140 to each other can be easily conducted only by slidingly operating the slide cover 130 while applying a small operating force in the fitting direction. Particularly, since the protrusion 125 serving as the fulcrum for the lever 150 which is rotated by the reciprocal movement of the slide cover 130 is protruded from the rib 124 of the female connector housing 120, it is possible to prevent the fulcrum from being moved with respect to the lever 150. According to this configuration, the lever 150 sufficiently exerts the leverage action by a small operating force on the slide cover 130, so that, without reducing the effect of the small operating force of the slide cover 130, the connector housings 120 and 140 can be fitted to each other smoothly and surely.

Furthermore, the lever 150 is surrounded by the slide cover 130 and is not protruded to the outside, and hence the lever 150 is prevented from being damaged by an external load force, etc. According to this configuration, without impairing the leverage action (the fitting function by a small operating force) of the lever 150, the fitting of the connector housings 120 and 140 can be always conducted easily and surely in a stable state.

Moreover, since the guide portion 141 serving as a point of action is integrally protruded from the one side face 140*a* of the male connector housing 140, the whole of the connector can be miniaturized and the production cost can be reduced. By means of the leverage action of the single lever 150 disposed on the slide cover 130, the work of fitting the multi-pole connector housings 120 and 140 to each other can be conducted easily and surely. Consequently, the number of parts can be reduced by the simple structure, so that the cost reduction of the whole of the connector can be further enhanced.

In the above-described second embodiment, the portion of a point of action which is disposed on the male connector housing is configured by the guide portion. Alternatively, the portion of a point of action may be configured by a support pin or the like. A single lever and single male connector housing are shown. Alternatively, two or more levers and male connector housings may be included. The lever is disposed on the side of the male connector housing. Alternatively, the lever may be disposed on the side of the female connector housing.

As described above, according to the second embodiment of the invention, the work of fitting the male and female connector housings to each other can be easily conducted by means of the leverage action. The leverage is produced only by sliding the slide member while applying a small operating force in the fitting direction. Particularly, the protrusion serving as the fulcrum of the lever, which is rotated by the reciprocal movement of the slide member, is disposed on the engaging portion of the other connector housing. Therefore, the fulcrum of the lever is prevented from being moved, and the lever sufficiently exerts the leverage action by a small operating force on the slide member, so that, without reducing the effect of the small operating force of the slide member, the connector housings can be fitted to each other smoothly and surely.

According to another aspect of the second embodiment of the invention, the lever is surrounded by the slide member so as not to be protruded to the outside, and hence the lever is prevented from being damaged by an external load force, etc. According to this configuration, the leverage action of the lever is not impaired and the fitting of the connector housings can be always conducted easily and surely in a stable state. The portion of the point of action on the second embodiment, which is disposed on the one connector housing is configured by the guide portion having a simple structure, and hence the whole of the connector can be miniaturized and the production cost can be reduced.

Figure 14:
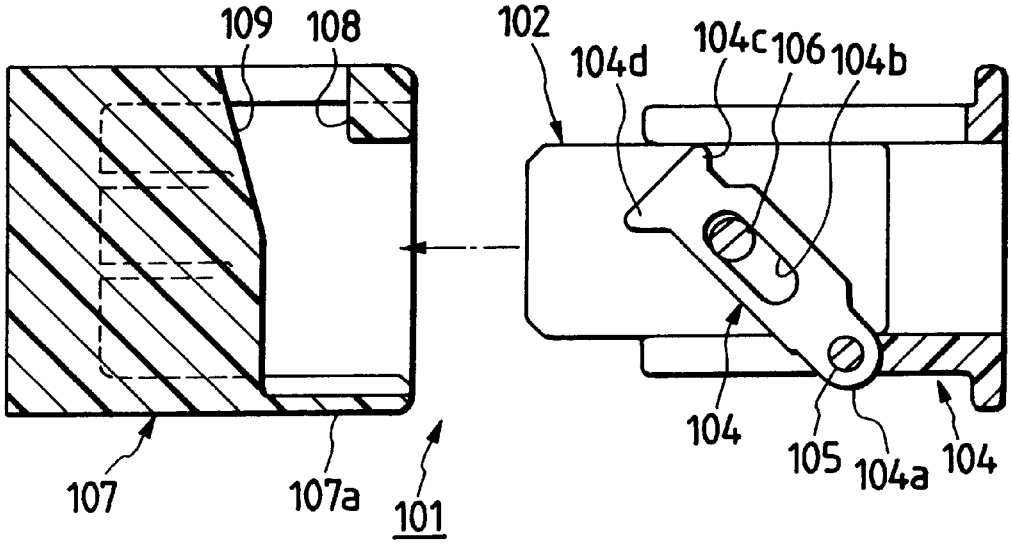
FIGS. 14–18 show stages in the fitting of a slidable attachable connector similar to the embodiment shown in FIGS. 4A–4C.
Figure 15:
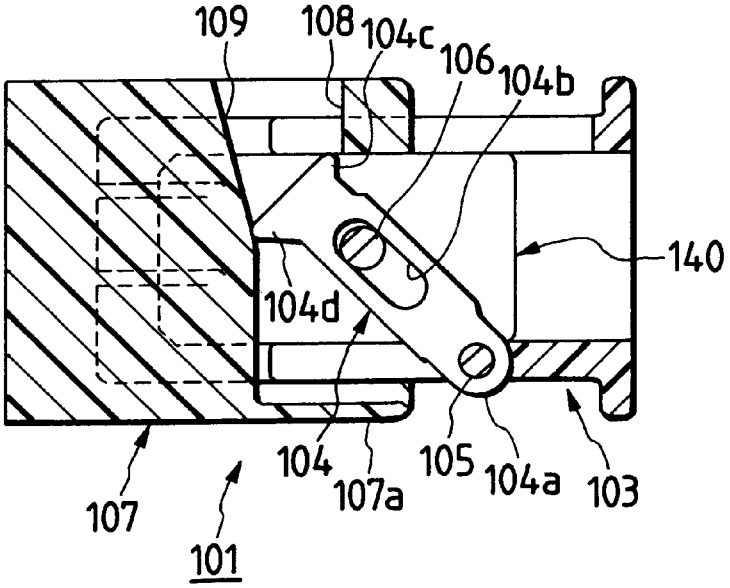
Figure 16:
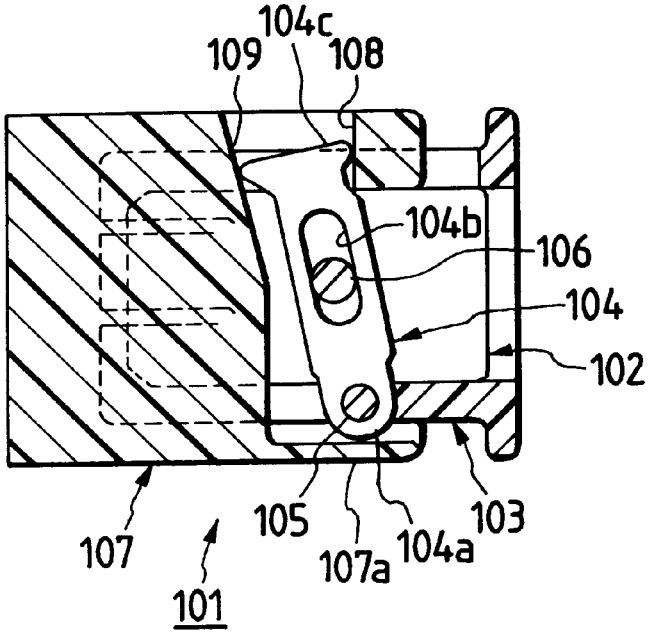
Figure 17:
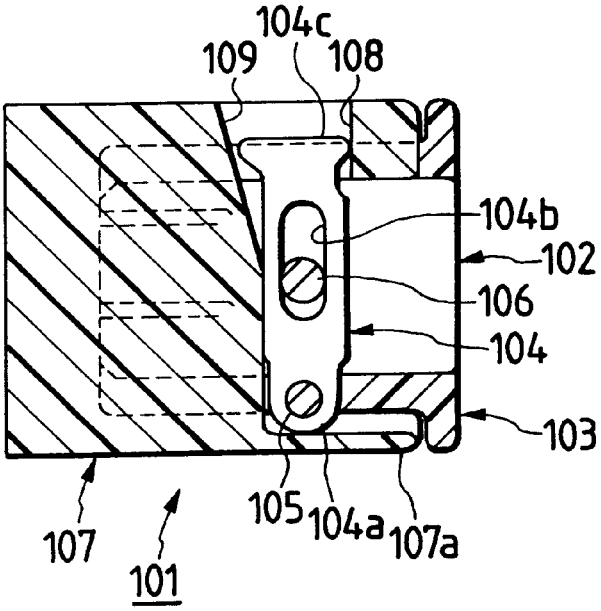
Figure 18:
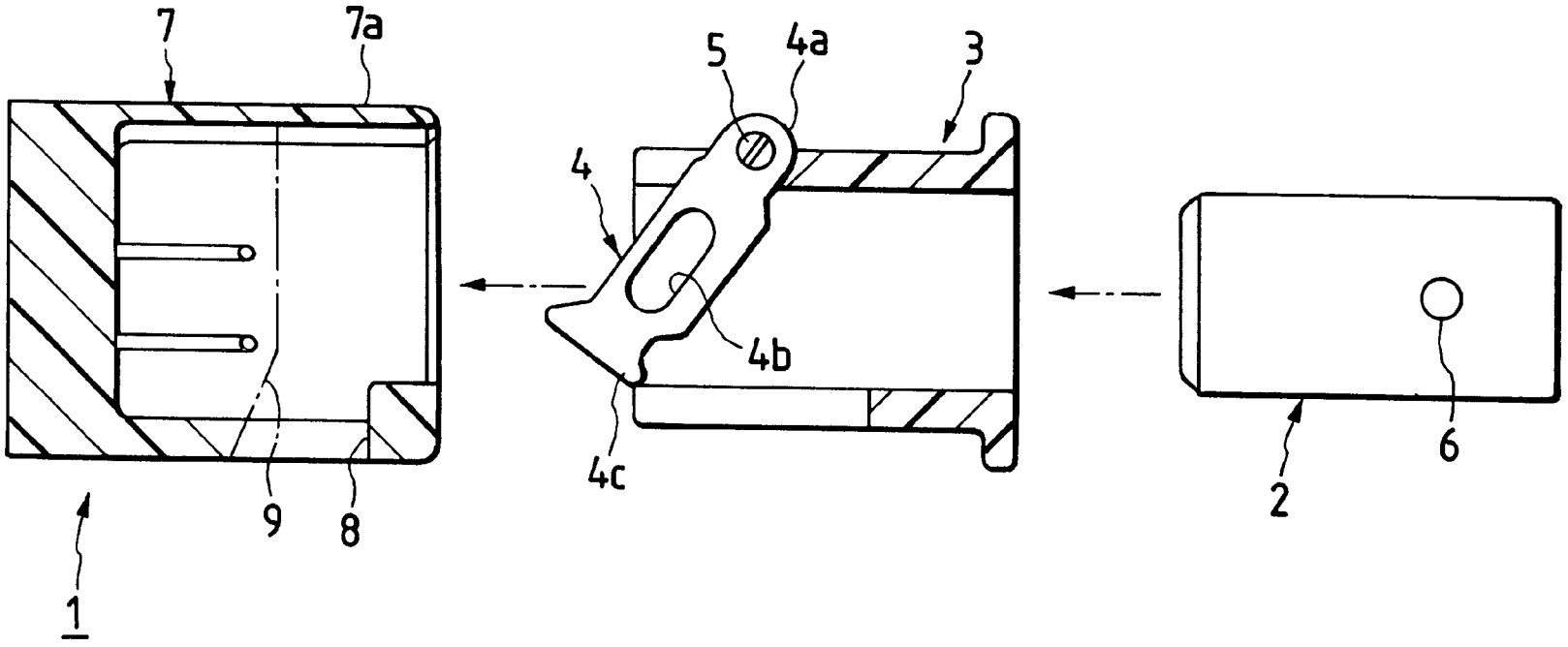
Figure 19:
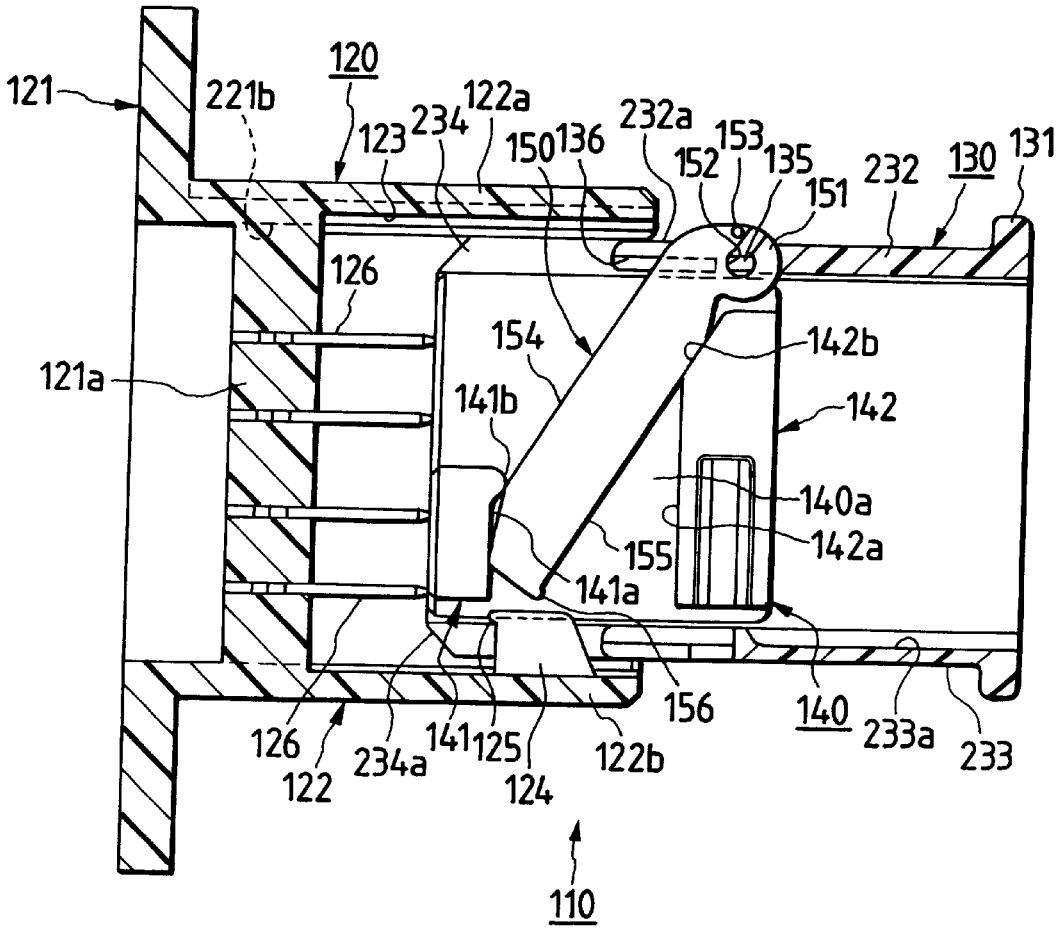
FIG. 19 is a section view showing a state immediately before start of fitting of a slidably fitting type connector according to a third embodiment of the invention.
Figure 20:
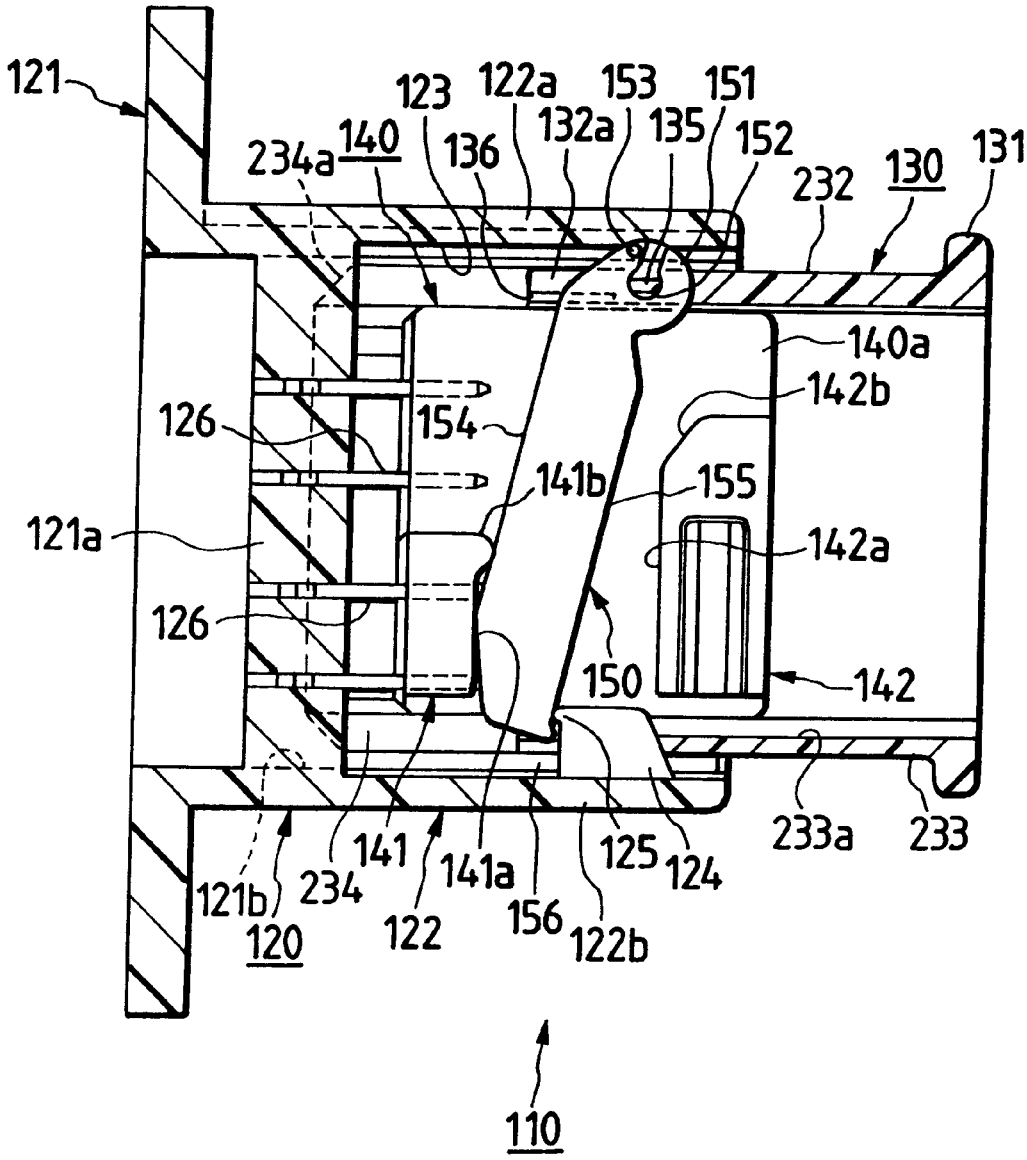
FIG. 20 is a section view showing a state in the course of fitting of the slidably fitting type connector shown in FIG. 19.
Figure 21:
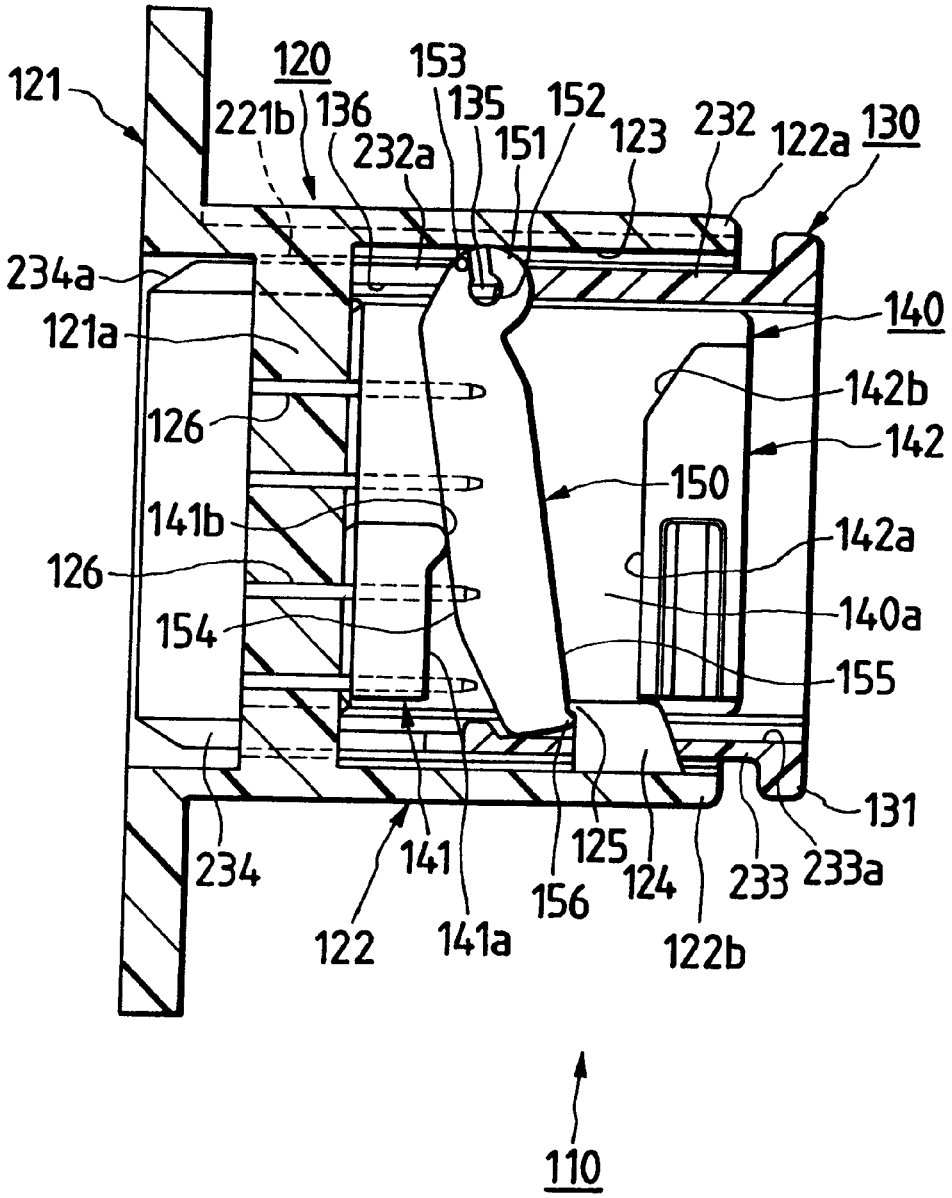
FIG. 21 is a section view showing a state in which fitting of the slidably fitting type connector shown in FIG. 19 has been completed.
Figure 22:
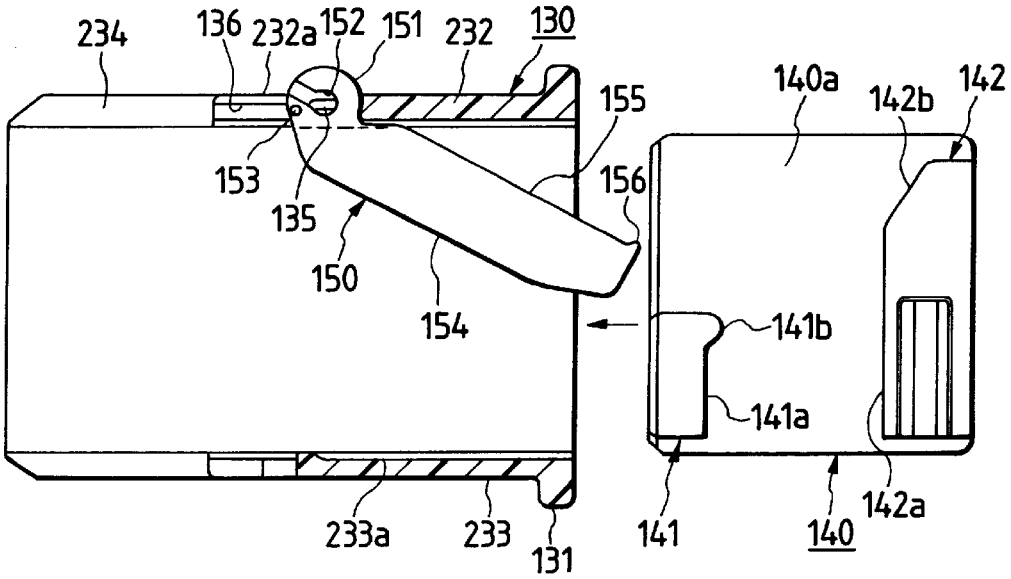
FIG. 22 is a section view showing a state in which a male connector housing of the slidably fitting type connector and a slide member to which a lever is provisionally fixed have not been attached to each other.
Figure 23:
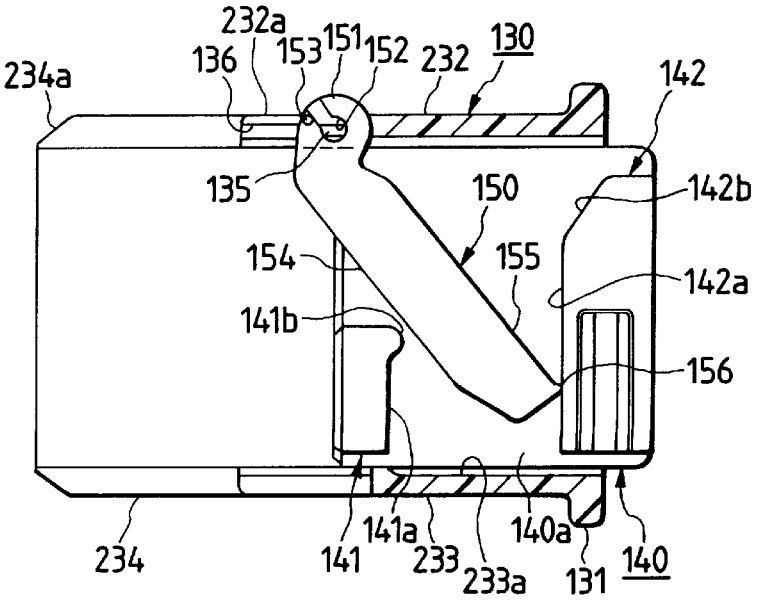
FIG. 23 is a section view showing a state in the course of attachment of the male connector housing and the slide member.
Figure 24:
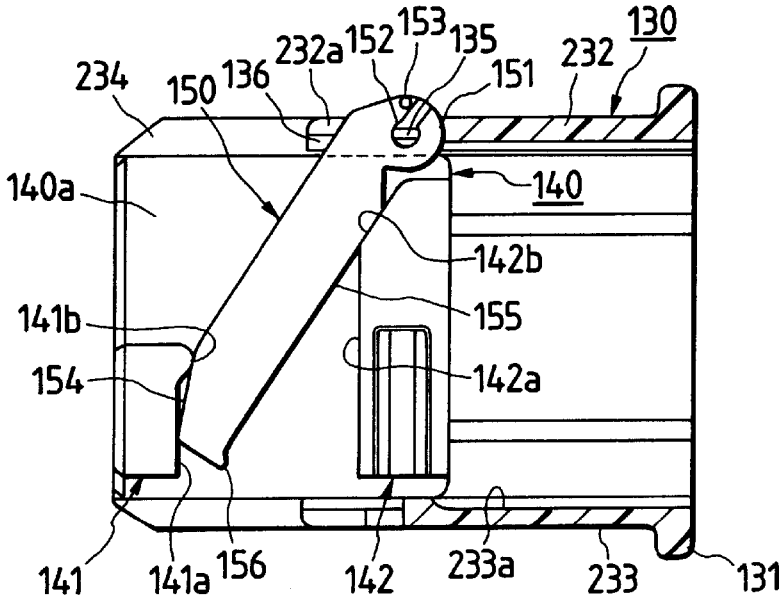
FIG. 24 is a section view showing a state in which attachment of the male connector housing and the slide member has been completed.

Referring again to the first embodiment of the invention, as shown in FIGS. 14–17, another potential problem is created by the male connector housing 102 being set at a position protruding from the tip of the slide member 103, before the connector housings 102 and 107 are fitted to each other. When an external load force is applied to the male connector housing 102, the male connector housing 102 is moved into the slide member 103. Therefore, unless the male connector housing 102 is returned to its normal position as shown in FIG. 14 before the work of fitting the housing to the female connector housing 107 is conducted, there is a possibility that the lever 104 and the male connector housing 102 will be damaged.

In view of the above-discussed potential problem a third embodiment of the invention has been developed in which the lever is prevented from being damaged and fitting of the connector housings is always surely conducted in a stable state.

Similarly to the above-discussed first and second embodiments of the invention, the third embodiment is a slidably fitting type connector in which a slide member is reciprocally slidably disposed on one of male and female connector housings. A base end portion of a lever that is rotated by reciprocating the slide member is rotatably supported on the slide member via a support shaft serving as a point of force. An intermediate portion of the lever is linked with a portion that constitutes a point of action on the one connector housing, and, when the connector housings are to be fitted to each other, a tip end portion of the lever is engageable with an engaging portion of the other connector housing. The slide member is slidably outwardly attached to the one connector housing, and a protective extension portion that surrounds the one connector housing is protruded from one side of the slide member.

In the slidably fitting type connector according to the third embodiment, in the normal position before fitting, the one connector housing is surrounded by the extension portion of the slide member and is not protruded to the outside. Therefore, the one connector housing is protected from any external loads and the lever is not damaged. As a result of this configuration, the function of the leverage action of the lever is not impaired and fitting of the connector housings is always surely conducted in a stable state.

Figure 25:
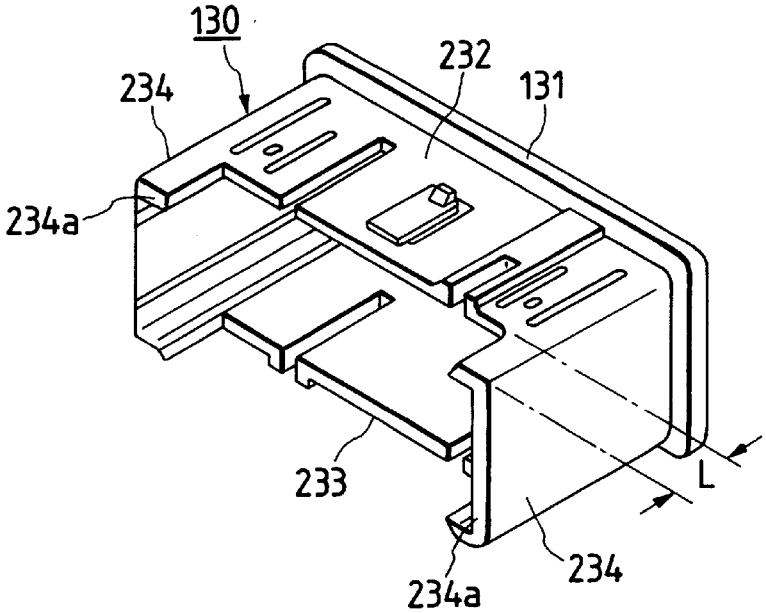
FIG. 25 is a perspective view of the slide member surrounding the male connector housing.

In a further beneficial aspect of the third embodiment, as best seen in FIG. 25, a tapered face is formed on a tip of the extension portion of the slide member.

The tapered face at the tip of the extension portion of the slide member serves as a guide in the fitting of the one connector housing to the other connector housing, so that the workability of the work of fitting of the connector housings is improved.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A slidably fitting connector, comprising:

a slide member that is reciprocally slidably disposed on one of a male connector housing and a female connector housing, a base end portion of a lever which is rotated by reciprocating said slide member is rotatably supported on said slide member via a support shaft serving as a point of force, an intermediate portion of said lever is linked with a portion forming a point of action of said one connector housing, and, when said connector housings are to be fitted to each other, a tip end portion of said lever is engageable with an engaging portion of said other connector housing, wherein said slide member is disposed to be reciprocally slidable in fitting and detaching directions of said connector housings, a protrusion that forms a fulcrum for the lever and over which said tip end portion of said lever slides is formed in said engaging portion of said other connector housing, and, when said slide member is moved forward, said tip end portion of said lever slides over said protrusion of said engaging portion of said other connector housing, whereby said one connector housing is pulled into said other connector housing to fit said connector housings to each other.

2. A slidably fitting connector according to claim 1, wherein said slide member is slidably outwardly attached to said one connector housing, and said lever is interposed between said slide member and said one connector housing.

3. A slidably fitting connector according to claim 1, wherein a guide portion serving as said portion forming a point of action is protruded from said one connector housing, and said intermediate portion of said lever is slidable with respect to said guide portion.

4. A slidably fitting connector, comprising:

a slide member that is reciprocally slidably disposed on one of a male connector housing and a female connector housing, a base end portion of a lever which is rotated by reciprocating said slide member is rotatably supported on said slide member via a support shaft serving as a point of force, an intermediate portion of said lever is linked with a portion forming a point of action of said one connector housing, and, when said connector housings are to be fitted to each other, a tip end portion of said lever is engageable with an engaging portion of said other connector housing, wherein said base end portion of said lever is provisionally fixable to said slide member via provisional fixing means, a lever pushing portion over which a sliding contact portion on a tip side of said lever slides is protruded from said one connector housing, and, when said sliding contact portion on said tip side of said lever slides over said lever pushing portion of said one connector housing, the provisional locking state of said lever is cancelled.

5. A slidably fitting connector according to claim 4, wherein said slide member is slidably outwardly attached to said one connector housing, and, when said slide member and said one connector housing are to be completely attached, said lever is guided to a normal position via a regulating face of said lever pushing portion.

6. A slidably fitting connector, comprising:

a slide member that is reciprocally slidably disposed on one of a male connector housing and a female connector housing, a base end portion of a lever which is rotated by reciprocating said slide member is rotatably supported on said slide member via a support shaft serving as a point of force, an intermediate portion of said lever is linked with a portion forming a point of action on said one connector housing, and, when said connector housings are to be fitted to each other, a tip end portion of said lever is engageable with an engaging portion of said other connector housing, wherein said slide member is slidably outwardly attached to said one connector housing, and an extension portion which surrounds said one connector housing is protruded from a tip side of said slide member.

7. A slidably fitting connector according to claim 6, wherein a tapered face is formed on a tip of said extension portion of said slide member.

8. A connector, comprising:

a female connector housing;

a male connector housing adapted to be mated with said female connector housing;

a slide member adapted to slidably receive one of said housings;

a lever member having first and second ends and an intermediate portion, said first end of said lever member being pivotally supported on said slide member, said intermediate portion being engaged with a portion of said one of said housings, and said second end of said lever member being adapted to abut an engaging portion on the other of said housings.

9. The connector according to claim 8, wherein said second end of said lever member includes a first tip portion that abuts a first engaging portion on the other of said housings when said slide member is moved in a first direction and said housings are connected to each other, and a second tip portion that abuts a second engaging portion on the other of said housings when said slide member is moved in a second direction opposite from said first direction and said housings are detached from each other.

10. The connector according to claim 9, wherein said slide member includes substantially parallel upper and lower walls with opposing slits formed in said upper and lower walls such that said first end of said lever member is pivotally supported in one of said slits and said second end of said lever member is freely inserted in and separated from the other of said slits.

11. The connector according to claim 8, wherein said intermediate portion of said lever member includes a slot engaged with a pin protruding from said one of said housings.

12. The connector according to claim 8, wherein said intermediate portion of said lever member includes a surface slidable along a protrusion from said one of said housings.

13. The connector according to claim 8, wherein said engaging portion on the other of said housings is formed as a protrusion from the other of said housings that contacts said lever member at a fulcrum point which remains in substantially the same position relative to the other of said housings as said lever member pivots about said first end.

14. The connector according to claim 13, wherein said first end of said lever member includes means for maintaining said lever member at a desired angle relative to said slide member during a first part of the assembly of said slide member and said one of said housings.

15. The connector according to claim 14, wherein said one of said housings includes means for moving said lever member from said desired angle during a second part of the assembly of said slide member and said one of said housings.

16. The connector according to claim 8, wherein said slide member includes wall extensions that substantially surround and protect said one of said housings before and during mating of said housings.

* * * * *